US006212718B1

(12) United States Patent
Stolpmann et al.

(10) Patent No.: US 6,212,718 B1
(45) Date of Patent: Apr. 10, 2001

(54) AIR-OVER-FOAM MATTRESS

(75) Inventors: James R. Stolpmann; Kenneth R. Smith, both of Charleston; Roger D. Dalton, Moncks Corner; Gary W. Ferdon, Charleston; Jonathan H. Mueller, Mt. Pleasant, all of SC (US)

(73) Assignee: Hill-Rom, Inc, Batesville, IN (US)

( * ) Notice: Subject to any disclaimer, the term of this patent is extended or adjusted under 35 U.S.C. 154(b) by 0 days.

(21) Appl. No.: 09/281,888

(22) Filed: Mar. 31, 1999

Related U.S. Application Data

(60) Provisional application No. 60/080,087, filed on Mar. 31, 1998, and provisional application No. 60/105,374, filed on Oct. 23, 1998.

(51) Int. Cl.[7] ..... A61G 7/057

(52) U.S. Cl. ..... 5/713; 5/709; 5/711; 5/723; 5/738; 5/727; 285/914

(58) Field of Search ..... 5/411, 709, 710, 5/711, 713, 722, 723, 727, 734, 738, 925, 914, 420, 730; 285/124.1, 124.3, 124.4, 914, FOR 118

(56) References Cited

U.S. PATENT DOCUMENTS

| | | | | |
|---|---|---|---|---|
| 371,938 | * | 10/1887 | Hinsdill | 5/722 |
| 3,268,922 | * | 8/1966 | Moxley | 5/420 |
| 3,580,615 | * | 5/1971 | Prosser | 285/124.3 |
| 4,494,775 | * | 1/1985 | Nash et al. | 285/124.1 X |
| 4,555,130 | * | 11/1985 | McClain | 285/914 X |
| 4,638,519 | | 1/1987 | Hess . | |
| 4,803,744 | | 2/1989 | Peck et al. . | |
| 4,896,389 | | 1/1990 | Chamberland . | |
| 4,900,065 | * | 2/1990 | Houck | 285/124.4 X |
| 4,949,412 | * | 8/1990 | Goode | 5/914 X |
| 5,029,352 | | 7/1991 | Hargest et al. . | |
| 5,051,673 | | 9/1991 | Goodwin . | |
| 5,111,544 | * | 5/1992 | Graebe | 5/925 X |
| 5,182,826 | | 2/1993 | Thomas et al. . | |
| 5,267,364 | | 12/1993 | Volk . | |
| 5,311,623 | * | 5/1994 | Hendi | 5/710 X |
| 5,323,500 | | 6/1994 | Roe et al. . | |
| 5,325,551 | | 7/1994 | Tappel et al. . | |
| 5,331,698 | | 7/1994 | Newkirk et al. . | |
| 5,373,595 | * | 12/1994 | Johnson et al. | 5/914 X |
| 5,375,273 | * | 12/1994 | Bodine, Jr. et al. | 5/914 X |
| 5,394,576 | | 3/1995 | Soltani et al. . | |
| 5,483,709 | | 1/1996 | Foster et al. . | |
| 5,542,136 | | 8/1996 | Tappel . | |
| 5,586,346 | | 12/1996 | Stacy et al. . | |
| 5,588,167 | | 12/1996 | Pahno et al. . | |
| 5,594,963 | | 1/1997 | Berkowitz . | |
| 5,611,096 | | 3/1997 | Bartlett et al. . | |
| 5,623,736 | | 4/1997 | Soltani et al. . | |
| 5,647,079 | | 7/1997 | Hakamiun et al. . | |
| 5,666,681 | | 9/1997 | Meyer et al. . | |
| 5,781,949 | | 7/1998 | Weismiller et al. . | |
| 5,802,646 | | 9/1998 | Stolpmann et al. . | |
| 5,865,474 | * | 2/1999 | Takahashi | 285/124.4 |
| 5,904,172 | * | 5/1999 | Gifft et al. | 5/713 X |
| 5,920,934 | * | 7/1999 | Hannagan et al. | 5/713 |
| 5,966,762 | * | 10/1999 | Wu | 5/713 X |
| 6,061,855 | | 5/2000 | Flick . | |

* cited by examiner

*Primary Examiner*—Michael F. Trettel
(74) *Attorney, Agent, or Firm*—Bose McKinney & Evans LLP

(57) ABSTRACT

A mattress structure (30) having a plurality of side-by-side lower support elements (50), a layer of material (54) underlying the lower support elements (50), and a plurality of side-by-side upper support elements (52) overlying and being supported by lower support elements (50) is described. The upper support elements (52) are connected by a plurality of tethers (128) to the layer of material (54), with the tethers (128) extending between adjacent lower support elements (50). Each of one of the upper support elements (52) and lower support elements (50) is an inflatable air bladder with specified sets of air bladders defining tube set zones (142, 144, 146). The pressure of the zones (142, 144, 146) is controlled by an air pressure system (170).

68 Claims, 22 Drawing Sheets

512
MEASURE PRESSURE IN SELECTED ZONE
518
OPEN VENT VALVE
514
DOES SELECTED ZONE NEED DEFLATION?
YES
516
OPEN VALVE ASSOCIATED WITH SELECTED ZONE
NO
520
IS VENT VALVE OPEN?
YES
522
CLOSE VENT VALVE
NO
526
SELECT THE NEXT ZONE
524
CLOSE VALVE ASSOCIATED WITH SELECTED ZONE

AIR-OVER-FOAM MATTRESS

BACKGROUND AND SUMMARY OF THE INVENTION

This application claims the benefit of U.S. provisional application Serial No. 60/080,087 filed Mar. 31, 1998, now expired and U.S. provisional application Serial No. 60/105,374 filed Oct. 23, 1998, now expired.

The present invention relates to a mattress and particularly, to a mattress for use on a hospital bed. More particularly, the present invention relates to a hospital mattress having air bladders for supporting a bedridden patient requiring long term care.

Mattresses that include air bladders to support bedridden patients in hospitals are known in the art. Such mattresses typically include apparatus for inflating the air bladders to predetermined pressure levels and for maintaining and adjusting the pressure in the air bladders after inflation. See, for example, U.S. Pat. Nos. 5,594,963 to Berkowitz; 5,542,136 to Tappel; 5,325,551 to Tappel et al.; and 4,638,519 to Hess. See also, U.S. Pat. Nos. 5,586,346 to Stacy et al.; 5,182,826 to Thomas et al.; and 5,051,673 to Goodwin, the assignee of each of these patents being the assignee of the present invention.

It is desirable for the interface pressure between a patient and the mattress supporting the patient to be evenly distributed over the mattress so as to minimize the formation of pressure ulcers. Some hospital mattresses include a plurality of side-by-side elements, such as foam blocks or air bladders, that vary in firmness depending upon the portion of the patient to be supported by the respective element. It is desirable for the friction between the side-by-side elements to be minimized so that each element compresses and expands individually without interference from adjacent elements.

According to the present invention, a mattress structure includes a plurality of side-by-side lower support elements and a layer of material underlying the lower support elements. The mattress structure further includes a plurality of side-by-side upper support elements overlying and supported by the lower support elements. In addition, the mattress structure includes a plurality of tethers. Each tether connects a respective one of the upper support elements to the layer of material and each tether extends between a respective pair of the lower support elements.

In illustrated embodiments, the upper support elements are air bladders and the lower support elements are foam blocks. The mattress structure further includes a plurality of sleeves made of a shear material with a low coefficient of friction. Each lower support element is received in an interior region of the respective sleeve. Each tether is also made of a shear material with a low coefficient of friction. In addition, each tether extends between a respective pair of the sleeves. Each sleeve is anchored to the layer of material so that longitudinal shifting of the lower support elements relative to the layer of underlying material is prevented. Receipt of the tethers between respective sleeves and the associated lower support elements prevents longitudinal shifting of the upper support elements.

Also according to the present invention, a modular mattress system includes a mattress having a plurality of inflatable air bladder sets. The modular mattress system further includes an air bladder inflation system having a compressor and a plurality of pressure sensors. Each pressure sensor is responsive to the pressure in an associated air bladder set. The air bladder inflation system further includes a bladder set selector that receives a pressure signal from each of the pressure sensors. The bladder set selector is responsive to only one pressure signal at a time.

The bladder set selector fluidly couples a selected one of the air bladder sets to the compressor and operates the compressor to increase the pressure in the selected air bladder set if the respective pressure sensor indicates that the pressure in the selected air bladder set is below a predetermined level. The bladder set selector couples the selected air bladder set to the atmosphere to allow fluid to bleed from the selected air bladder set to the atmosphere if the respective pressure sensor indicates that the pressure in the selected air bladder set is above a predetermined level. Each of the unselected air bladder sets remain fluidly decoupled from the compressor and fluidly decoupled from the atmosphere. The bladder set selector selects each of the air bladder sets in a cyclical manner.

In illustrated embodiments, the bladder set selector includes a manifold having a main passage coupled to the compressor and coupled to the atmosphere at a vent port. The manifold includes a plurality of bladder passages coupled to the main passage at respective bladder ports and coupled to respective air bladder sets. A vent valve is movable to open and close the vent port. A plurality of bladder valves are movable to open and close respective bladder ports. A plurality of actuators are coupled to respective bladder valves and the vent valve. The bladder set selector includes a microprocessor that receives signals from the pressure sensors and sends signals to the actuators. In illustrated embodiments, the actuators are stepper motors and the microprocessor sends signals to each stepper motor to open the associated valve one step at a time until the desired pressure is achieved in the respective air bladder set. When the desired pressure is achieved, the microprocessor sends signals to quickly close the opened valve.

Further according to the present invention, the mattress structure includes a cover enclosing the plurality support elements. The cover includes a bottom surface and a strap having two spaced apart free ends and a middle portion between the free ends connected to the lower outer surface. The support elements are configured to allow the mattress structure to be folded so that the free ends of the strap may be coupled together.

In the illustrated embodiment, the apparatus includes a buckle having a first buckle half and a second buckle half. The first and second buckle halves are attached to the strap. The first buckle half is coupled to the strap for movement relative to the second buckle half to adjust an effective length of the strap. Also in the illustrated embodiment, an anti-skid pad is coupled to the bottom surface of the mattress.

Still further according to the present invention, a connector apparatus is configured to couple a mattress including a plurality of inflatable air bladders to an air bladder inflation system including an air supply. The connector apparatus includes a first set of connectors coupled to the air supply. The first set of connectors is coupled to a first body portion. The apparatus also includes a plurality of air supply tubes, at least one air supply tube being coupled to each of the plurality of air bladders, and a second set of connectors coupled to the air supply tubes. The second set of connectors are coupled to a second body portion. The first and second sets of connectors are in alignment with each other to permit substantially simultaneous coupling of the first and second sets of connectors.

In the illustrated embodiment, the air bladder inflation system also includes a plurality of pressure sensors. Each pressure sensor is responsive to the pressure in an associated air bladder. The connector apparatus includes a third set of connectors coupled to the pressure sensors. The third set of connectors is coupled to the first body portion. The apparatus also includes a plurality of pressure tubes, at least one pressure tube being coupled to each of the plurality of air bladders, and a fourth set of connectors coupled to the pressure tubes. The fourth set of connectors is coupled to the second body portion. The third and fourth sets of connectors are also in alignment with each other to permit substantially simultaneous coupling of both the first set of connectors with the second set of connectors and the third set of connectors with the forth set of connectors.

Also in the illustrated embodiment, the air bladder inflation system further includes a manifold having a main passage coupled to the air supply and coupled to the atmosphere at a vent port. The manifold includes a plurality of bladder passages coupled to the main passage at respective bladder ports and coupled to the first set of connectors. A vent valve is movable to open and close the vent port, and a plurality of bladder valves are movable to open and close respective bladder ports. A plurality of actuators are coupled to respective bladder valves and the vent valve.

Also in the illustrated embodiment, a latch configured to secure the first and second bodies together. The latch is illustratively coupled to one of the sets of connectors. The illustrated air bladder inflation system includes a housing surrounding the air supply and the plurality of pressure sensors. The first body portion is illustratively coupled to the housing. Also illustratively, the first and second sets of connectors are unequally spaced on the first body portion and the third and fourth sets of connectors are unequally spaced on the second body portion so that the connectors can only being coupled together in a single orientation.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 25 is an exploded view of the male housing connector of FIG. 22 showing the six male connector portions and an electrical wiring pass through.

DETAILED DESCRIPTION OF THE DRAWINGS

Figure 1:
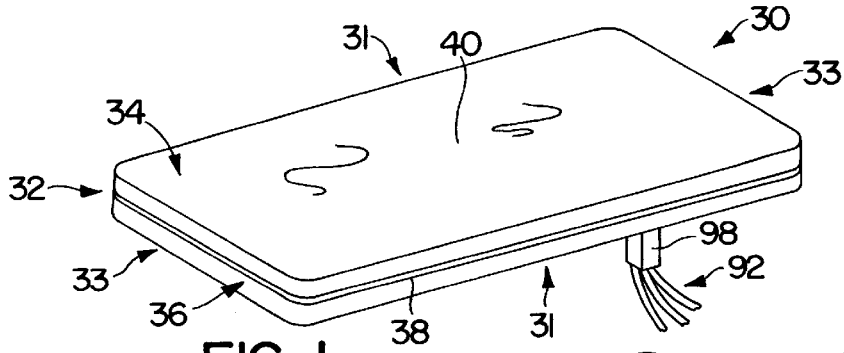
FIG. 1 is a perspective view of a mattress according to the present invention showing top and bottom mattress covers zipped together to enclose other mattress components.
Figure 2:
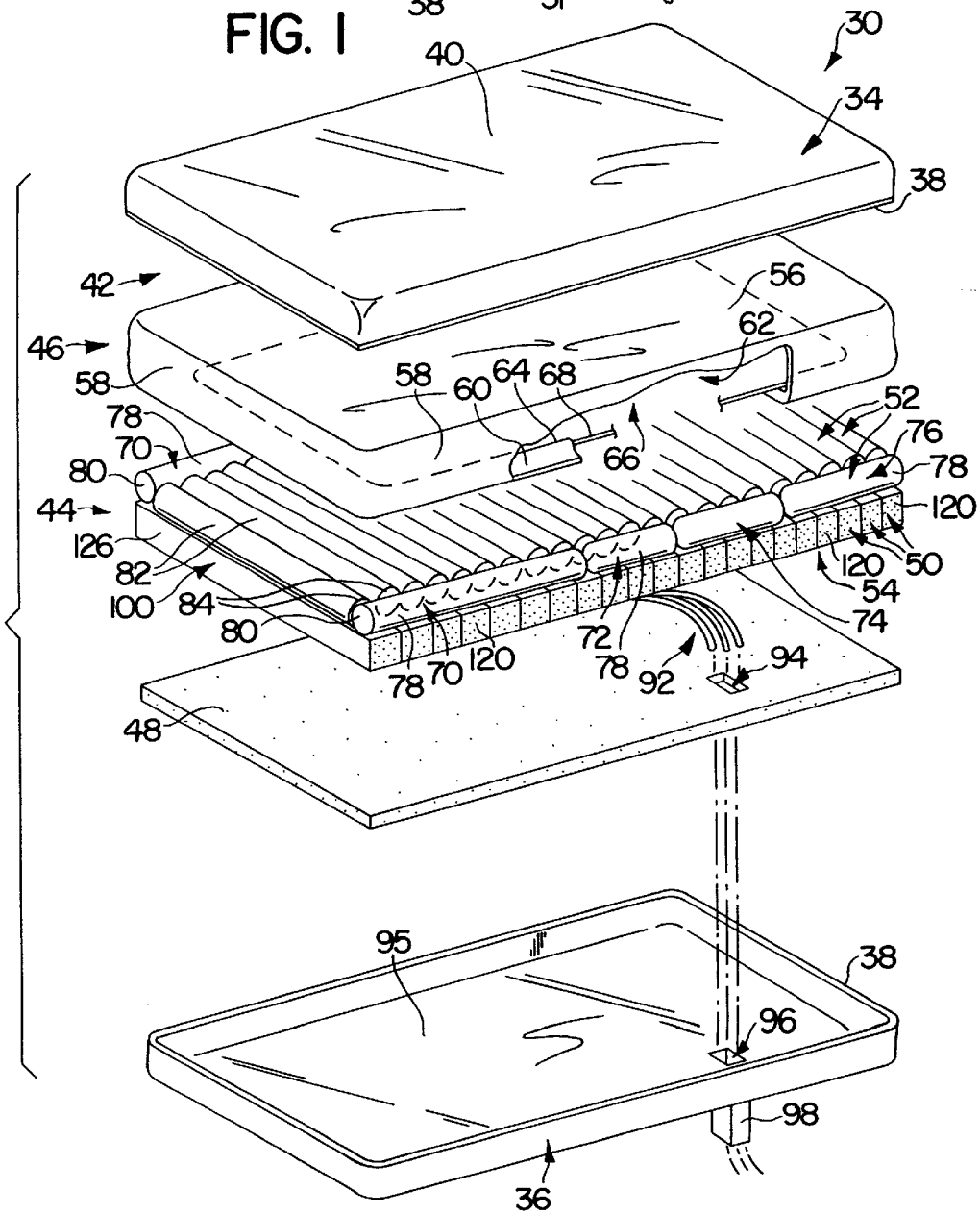
FIG. 2 is an exploded perspective view of the mattress of FIG. 1, with portions broken away showing the top cover unzipped and separated away from the bottom cover to expose the other mattress components which include an inner shear cover beneath the top cover, an air-over-foam core structure beneath the inner shear cover, an optional foam base beneath the air-over-foam mattress structure, the optional foam base including an air tube pass-through aperture, and a protective sleeve extending downwardly from the bottom cover to protect air tubes that pass therethrough.

A mattress structure 30 in accordance with the present invention includes a mattress cover 32 having a top cover 34 and a bottom cover 36 connected to top cover 34 by a zipper 38 as shown in FIG. 1. Top cover 34 includes an upwardly facing sleeping surface 40 configured to support a patient. Top cover 34 cooperates with bottom cover 36 to provide mattress cover 32 with an interior region 42 as shown in FIG. 2. Mattress structure 30 includes a core structure 44 and an inner shear cover 46 each of which are received in interior region 42 of cover 32. In illustrated embodiments, mattress structure 30 also includes a foam base 48 received in interior region 42 along with core structure 44 and inner shear cover 46. In other embodiments, mattress structure 30 does not include foam base 48.

Mattress structure 30 includes longitudinally extending, transversely spaced-apart sides 31 and transversely extending, longitudinally spaced-apart ends 33 as shown in FIG. 1. Sides 31 of mattress structure 30 are longer than ends 33 of mattress structure 30. Thus, mattress structure 30 is rectangular in shape. However, the teachings of the present invention may be used with mattress structures having other shapes.

Figure 4:
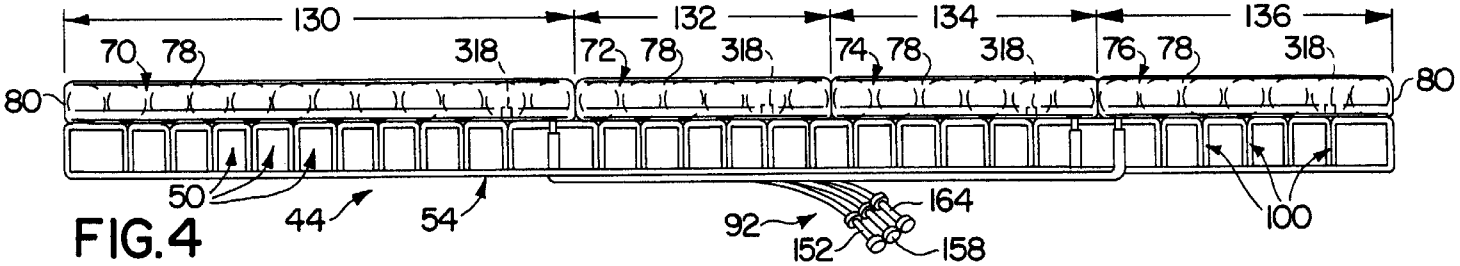
FIG. 4 is a side elevation view of the air-over-foam core structure of FIG. 2 showing a plurality of transversely extending foam blocks with square cross section arranged in side-by-side relation between head and foot ends of the mattress and a plurality of cylindrical air bladders supported by the plurality of foam blocks.

Core structure 44 includes a plurality of lower support elements 50 and a plurality of upper support elements 52 that are supported by lower support elements 50 as shown in FIGS. 2 and 4. In illustrated embodiments, lower support elements 50 are transversely extending foam blocks and upper support elements are somewhat cylindrically-shaped air bladders. Hereinafter, the lower support elements 50 are referred to as foam blocks 50 and the upper support elements 52 are referred to as air bladders 52. Core structure 44 further includes a layer of material 54 that underlies foam blocks 50. Foam blocks 50 and air bladders 52 are secured to layer of material 54 as described below in detail with reference to FIG. 5. Securing foam blocks 50 and air bladders 52 to layer of material 54 allows core structure 44 to be moved as a single unit with foam blocks 50 and air bladders 52 remaining held in the proper positions relative to one another and relative to layer of material 54.

Shear cover 46 includes a top panel 56, perimetral side panels 58 extending downwardly from top panel 56, and a fitted portion 60 appended to side panels 58 and extending at least partially beneath top panel 56. Top panel 56 cooperates with side panels 58 and fitted portion 60 to define an interior region 62 which receives core structure 44. Fitted portion 60 includes an inner perimetral edge 64 defining an opening 66 beneath top panel 56 allowing for movement of core structure 44 into and out of interior region 62 of shear cover 46. In illustrated embodiments, inner perimetral edge 64 of fitted portion 60 is provided with either an elastic band 68 or draw string or other suitable structure for drawing opening 66 of fitted portion 60 closed to facilitate wrapping shear cover 46 snugly around core structure 44.

Inner shear cover 46 is made from a material having a low coefficient of friction such as "parachute" material or any other material that will allow top cover 34 to slide relative to core structure 44. In the illustrative embodiment, inner shear cover 46 may be made from nylon rip stop 30 denier, style #66938 or 1.5 mil polyurethane material. Mattress cover 32 can be made from any of a number of materials, but, in illustrated embodiments, top cover 34 is made from DARTEX™ TC-23/PO-93 urethane coated nylon fabric which allows for wipe-down cleaning and bottom cover 36 is made from STAPH-CHEK® or WEBLON® reinforced vinyl laminate.

Mattress structure 30 may be used with a bed or table including an articulating deck (not shown) having pivotable head, seat, thigh, and leg sections. As the deck articulates, mattress structure 30 bends along with the deck sections. Top cover 34 frictionally engages a user lying on sleep surface 40 so that, when mattress structure 30 bends during articulation of the deck, top cover 34 tends to move with the user rather than moving with core structure 44. Thus, providing shear cover 46 between top cover 34 and core structure 44 minimizes the rubbing of mattress structure 30 against the user during articulation of the deck.

Figure 19:
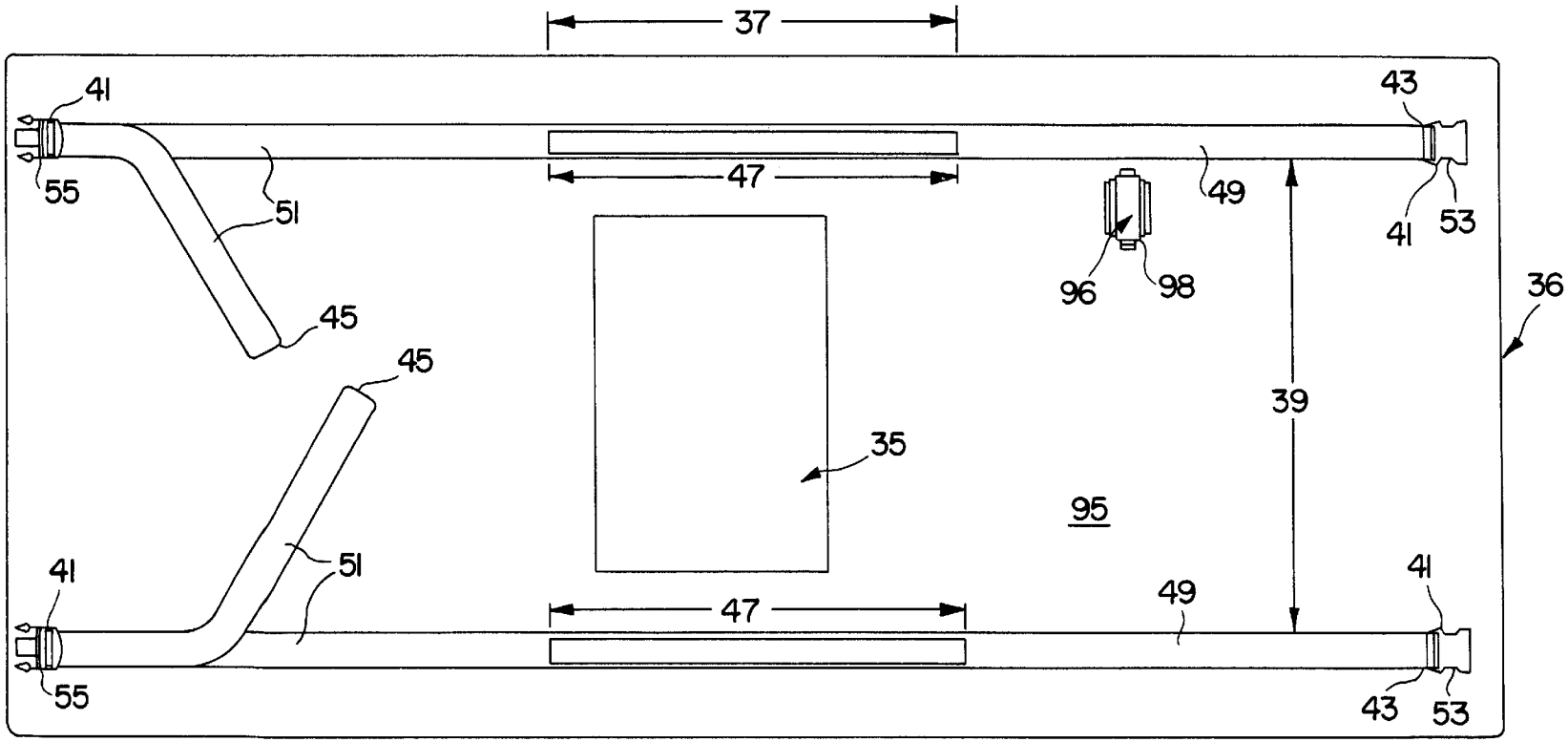
FIG. 19 is a bottom plan view of the mattress of FIG. 1 showing two transport straps each having spaced apart ends, a central portion attached to the bottom cover of the mattress, and cooperating buckle halves, and an anti-skid pad attached to the bottom cover of the mattress and also showing the protective sleeve extending from the bottom mattress cover.

An anti-skid pad 35 is RF welded, stitched, bonded, or otherwise appropriately attached to central region 37 of bottom cover 36 as shown, for example, in FIG. 19. Anti-skid pad 35 frictionally engages the bed or table (not shown) on which mattress structure 30 is used to inhibit movement of mattress structure 30 relative to the bed or table, especially during articulation of the deck. In the illustrated embodiment, anti-skid pad 35 is made from textured rubber but may be made from other materials which would increase the frictional forces between the mattress structure 30 and the bed or table.

Mattress structure 30 also includes transport straps 39 and buckles 41 coupled to transport straps 39. Transport straps 39 are attached to bottom cover 36, as shown, for example, in FIG. 19. Each transport strap 39 includes a first end 43, a spaced apart second end 45, a central portion 47, a first free portion 49 extending between first end 43 and central portion 47, and a second free portion 51 extending between second end 45 and central portion 47. Buckles 41 include a first buckle half 53 and a second buckle half 55 which may be selectively coupled to, and decoupled from first buckle half 53. In the illustrated embodiment, first buckle half 53 is attached to first end 43 of transport strap 39 and second buckle half 55 is attached to second free portion 51 of transport strap 39 to slide between second end 45 and central portion 47 of transport strap 39 to adjust the effective length of transport strap 39. In the illustrated embodiment, central portions 47 of two transport straps 39 are single stitch sewn to the central region 37 of bottom cover 36, as shown, for example, in FIG. 19.

Figure 20:
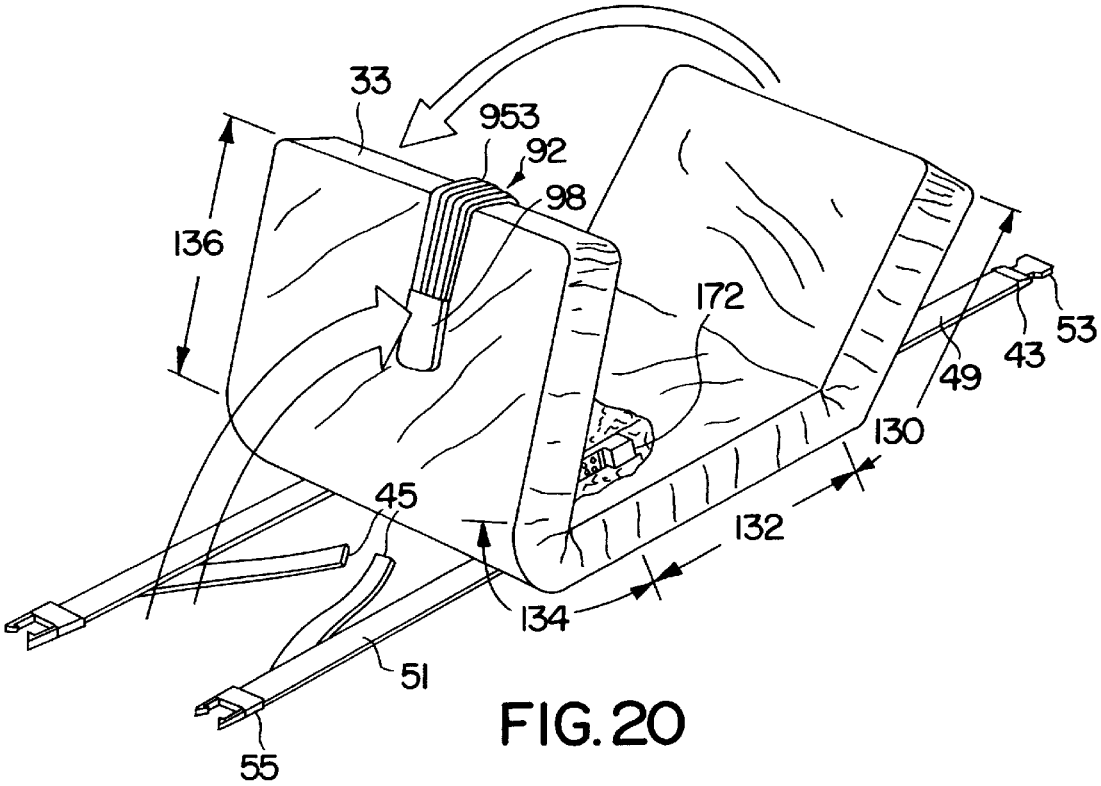
FIG. 20 is a perspective view of the mattress core of FIG. 1 showing the mattress being folded at two points in preparation for transport or storage.

Air-over-foam mattresses are not required for all patients at all times during their stay at a care facility so it is envisioned that facilities will rent air-over-foam mattresses from supply houses on an as needed basis or that facilities will purchase air-over-foam mattresses and store them until needed. The foam block and bladder construction of mattress structure 30 facilitates folding mattress structure 30 for shipping or storage, as shown, for example, in FIGS. 20 and 21. The plurality of laterally extending foam blocks 50 in mattress structure 30 define fold locations between each adjacent foam block 50, thus mattress structure 30 may be folded in many different ways. The illustrated embodiment of mattress structure 30 is preferably folded so that foot zone 136 will lie on top of seat and thigh zones 132, 134 and back zone 130 will lie on top of the foot zone 136, as shown, for example, in FIG. 21. This allows air tubes 92 to be wrapped around end 33 of foot zone 136 so that they are not exposed when mattress structure 30 is folded for transport or storage, as shown, for example, in FIGS. 20 and 21.

Figure 21:
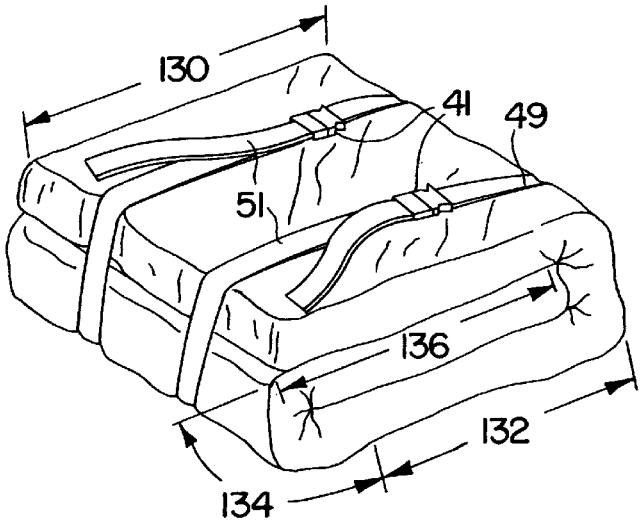
FIG. 21 is a perspective view of the mattress of FIG. 20 showing the mattress completely folded for transport or storage and the cooperating buckle halves on each transport strap coupled together.

Prior to folding mattress structure 30, air tubes 92 should be disconnected from housing 172 of air pressure system 170 and housing 172 should be placed on top of seat and thigh zones 132, 134 of mattress structure 30, as shown, for example, in FIG. 21. Thus after folding mattress structure 30, housing 172 will be protectively encased between seat and thigh zones 132, 134 and foot zone 136 so that foam blocks 50 of the mattress structure 30 will act as protective packing material for the housing 172.

In illustrated embodiments, air bladders 52 of core structure 44 include a pair of back section header bladders 70, a pair of seat section header bladders 72, a pair of thigh section header bladders 74, and a pair of foot section header bladders 76. Header bladders 70, 72, 74, 76 extend longitudinally relative to mattress structure 30 and are arranged in end-to-end relation along respective sides 31 of core structure 44 as shown best in FIG. 2. Header bladders 70, 72, 74, 76 each include a cylindrical portion 78 and a pair of end portions 80, as shown best in FIGS. 2 and 5. The rest of the plurality of air bladders 52 extend transversely between respective header bladders 70, 72, 74, 76 and are arranged in side-by-side relation between ends 33 of core structure 44. Each of the transversely extending air bladders 52 includes a cylindrical portion 82 and a pair of end portions 84, as also shown best in FIGS. 2 and 5.

Figure 5:
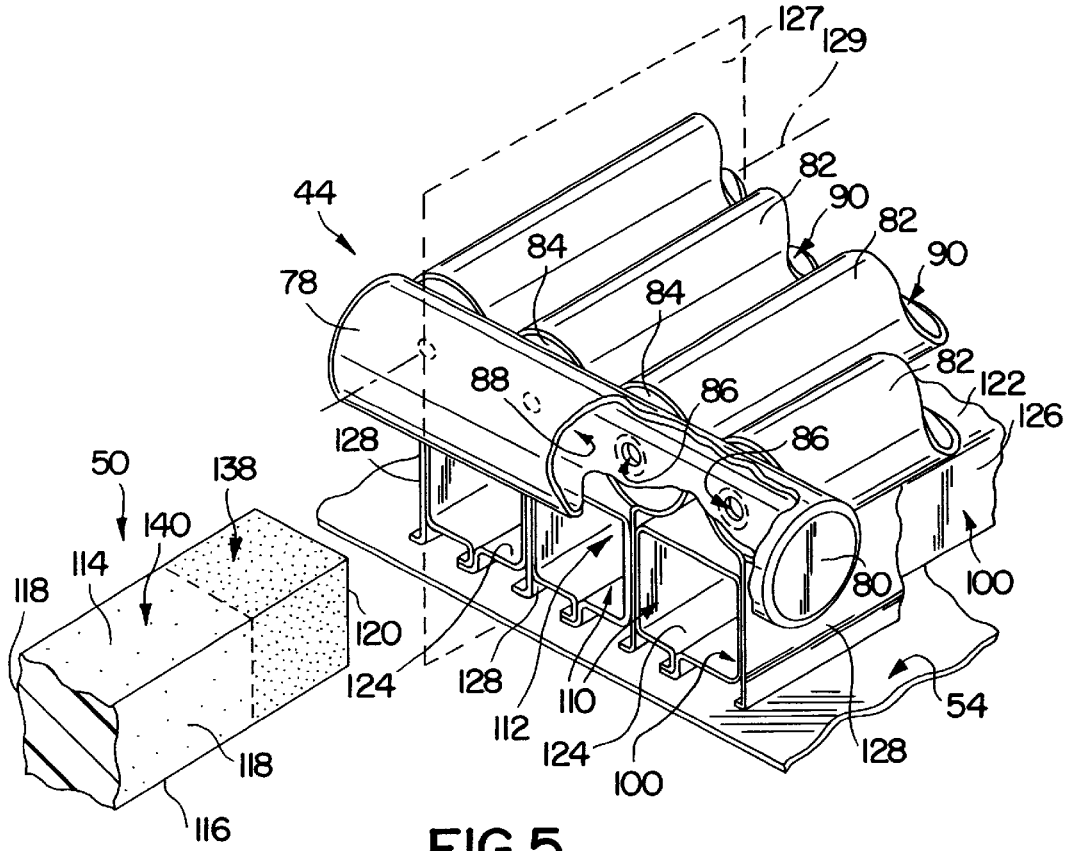
FIG. 5 is a perspective view of a portion of the air-over-foam core structure of FIG. 4, with portions broken away, showing a bottom layer of material, a plurality of square-shaped sleeves anchored to the layer of material, a portion of one of the plurality of foam blocks arranged for insertion into one of the square-shaped sleeves, and the plurality of air bladders including a longitudinally extending header bladder and a plurality of transversely extending bladders fluidly coupled to the header bladder, each transversely extending air bladder being tethered to the bottom layer of material.

Each end portion 84 of the transversely extending air bladders 52 is attached to respective cylindrical portions 78 of the associated header bladder 70, 72, 74, 76, for example, by radio frequency (RF) welding. A fluid port 86 is formed through each end portion 84 and through the respective cylindrical portion 78 of the associated header bladder 70, 72, 74, 76 so that an interior region 88 of each header bladder 70, 72, 74, 76 is in fluid communication with an interior region 90 of each of the transversely extending air bladders 52 attached thereto as shown in FIG. 5. Fluid ports 86 are formed in the regions where header bladders 70, 72, 74, 76 and the transversely extending air bladders 52 are attached together so that an air-tight seal is formed around the periphery of each fluid port 86.

Header bladders 70, 72, 74, 76 and the transversely extending air bladders 52 associated therewith are sized so as to be supported by the respective deck sections of the articulating deck with which mattress structure 30 is used. Thus, back section header bladders 70 and the associated transversely extending air bladders 52 provide mattress structure 30 with a back zone 130, shown in FIG. 4, which is supported by the underlying foam blocks 50 and the back section of the articulating deck. Similarly, seat, thigh, and foot section header bladders 72, 74, 76 and the associated transversely extending air bladders 52 provide mattress structure 30 with seat, thigh, and foot zones 132, 134, 136, respectively, which are supported by respective underlying foam blocks 50 and the seat, thigh, and foot sections, respectively, of the articulating deck.

Figure 3:
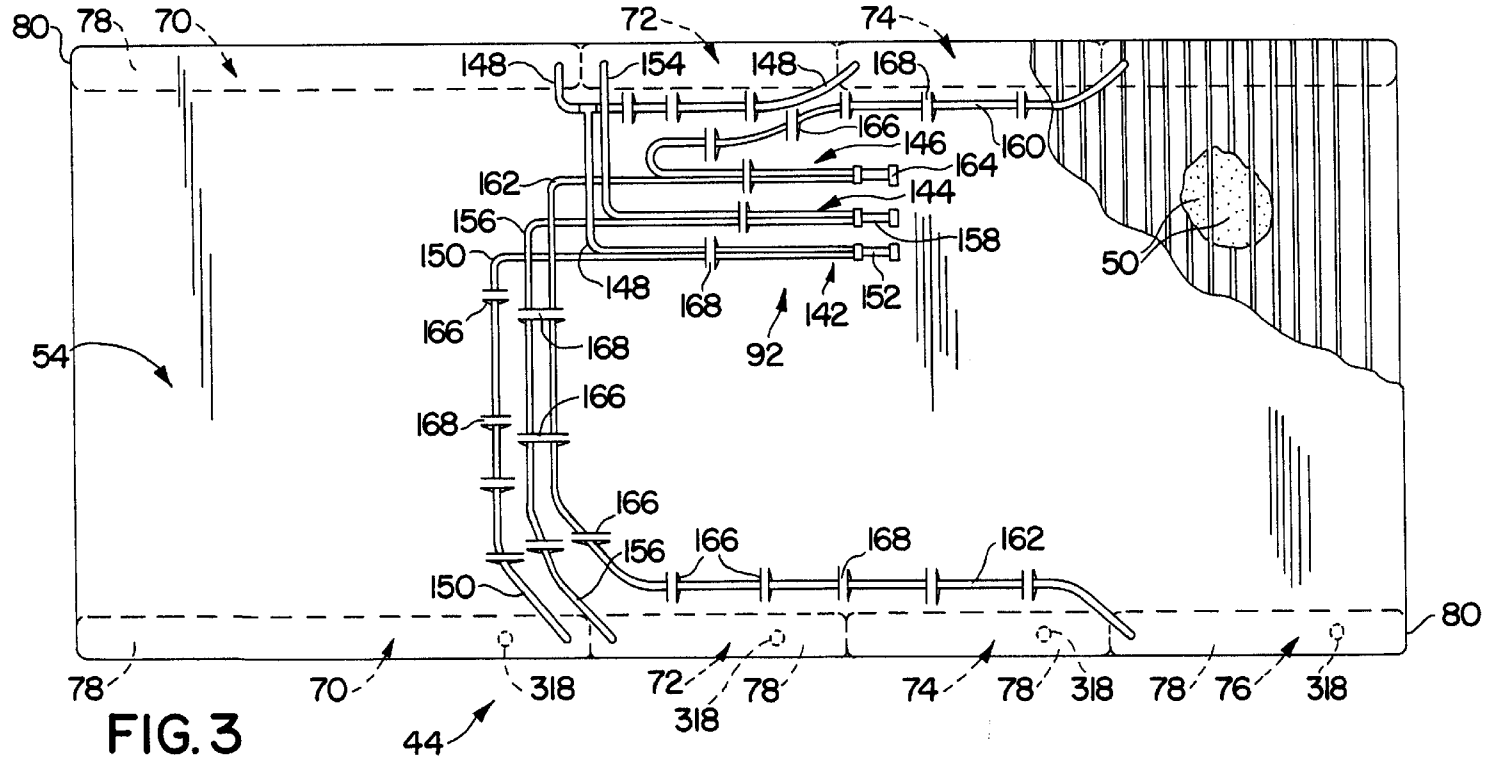
FIG. 3 is a bottom plan view of the air-over-foam core structure of the mattress of FIG. 1, with portions broken away, showing a plurality of air tubes routed to various zones of the mattress.

Mattress structure 30 includes a plurality of air tubes 92 that are routed to each of header bladders 70, 72, 74, 76 as shown best in FIG. 3. Foam base 48 is formed to include an aperture 94 as shown in FIG. 2. Bottom cover 36 includes a bottom sheet 95 that is formed to include an aperture 96. Bottom cover 36 also includes a protective sleeve 98 appended to bottom sheet 95 adjacent to aperture 96 and extending downwardly therefrom. Aperture 96 and sleeve 98 are aligned with aperture 94 allowing tubes 92 to be routed from interior region 42 of mattress structure 30 to the region outside of mattress structure 30. Protective sleeve 98 protects tubes 92 from being contacted and possibly damaged by components of the bed which support mattress structure 30 as the deck sections of the bed articulate.

Core structure 44 includes layer of material 54 to which foam blocks 50 and air bladders 52 are secured as previously described and as shown in FIG. 5. Core structure 44 includes a plurality of square-shaped sleeves 100, each of which includes an interior region 112 and each of which are anchored to layer of material 54 by, for example, RF welding. Each sleeve 100 includes open ends 110 that allow foam blocks 50 to be inserted into interior region 112 of the respective sleeve 100. Each foam block 50 includes a top surface 114, a bottom surface 116, a pair of side surfaces 118 extending between top and bottom surfaces 114, 116, and a pair of end surfaces 120 extending between top and bottom surfaces 114, 116. Each sleeve 100 includes a top panel 122, a bottom panel 124, and a pair of side panels 126 extending between top and bottom panels 122, 124.

Sleeves 100 are sized so that foam blocks 50 fit snugly within interior region 112. Thus, top panel 122, bottom panel 124, and side panels 126 of sleeves 100 engage top surface 114, bottom surface 116, and side surfaces 118 of foam blocks 50, respectively. Engagement between panels 122, 124, 126 and surfaces 114, 116, 118 causes foam blocks 50 to resist transverse shifting within sleeves 100. In addition, securing sleeves 100 to layer of material 54 prevents longitudinal shifting of foam blocks 50. Thus, sleeves 100 hold foam blocks 50 in their respective positions relative to layer of material 54. In illustrated embodiments, the length of foam blocks 50 is such that foam blocks 50 extend substantially between sides 31 of mattress structure 30 and the length of each sleeve is substantially equivalent to the length of foam blocks 50 so that sleeves 100 completely surround surfaces 114, 116, 118 and so that end surfaces 120 of foam blocks 50 are aligned with open ends 110 of sleeves 100. Each sleeve 100 is made from a material having a low coefficient of friction, such as urethane coated nylon twill, to provide foam blocks 50 with an anti-friction shear coating. Layer of material 54 is also made from a material having a low coefficient of friction.

Although sleeves 100 completely surround surfaces 114, 116, 118 of foam blocks 50, it is within the scope of the invention as presently perceived for core structure 44 to include sleeves that are U-shaped having a top panel and a pair of side panels that extend downwardly from the top panel to attach to layer of material 54 so that bottom surfaces 116 of foam blocks 50 engage layer of material 54. In addition, although each sleeve 100 includes two open ends 110, it is within the scope of the invention as presently perceived for core structure 44 to include sleeves having only one open end.

Core structure 44 includes a plurality of tethers 128 that connect respective transversely extending air bladders 52 to layer of material 54 as shown in FIG. 5. Tethers 128 extend downwardly from air bladders 52 between side panels 126 of respective pairs of sleeves 100 and attach to layer of material 54 by, for example, RF welding. In illustrated embodiments, tethers 128 are formed integrally with transversely extending air bladders 52. However, it is within the scope of the invention as presently perceived for tethers 128 to be separate pieces that attach to air bladders 52 as well as to layer of material 54. The majority of transversely extending air bladders 52 are arranged above foam blocks 50 so that approximately half of each transversely extending air bladder 52 is supported by the respective underlying foam block 50 as shown, for example, in FIG. 4. However, the foam blocks 50 at ends 33 of mattress structure 30 are slightly larger in cross section than the other foam blocks 50 so that the transversely extending air bladders 52 at ends 33 of mattress structure are supported by these slightly larger foam blocks 50 as also shown in FIG. 4. In addition, the air bladders 52 at ends 33 of mattress structure 30 do not have tethers 128 extending therefrom but instead, rely on the attachment to respective header bladders 70, 76 for proper positioning.

In illustrated embodiments, each tether 128 is a contiguous sheet of material that extends the full transverse length of the respective transversely extending air bladder 52. However, it is within the scope of the invention as presently perceived for tethers 128 to be shorter in length or to comprise several smaller sheets or strands that extend between a respective air bladder 52 and layer of material 54. Each tether 128 is sized so as to be substantially pulled taut when the respective underlying pair of foam blocks 50 are uncompressed as shown in FIG. 5. Thus, each tether 128 extends in a vertical reference plane 127 defined between respective pairs of adjacent foam blocks 50 and each tether 128 is positioned to lie vertically beneath a transverse central axis 129 of the associated air bladder 52 as also shown in FIG. 5.

Each tether 128 is made of an anti-friction shear material having a low coefficient of friction, such as urethane coated nylon twill, and each pair of adjacent sleeves 100 contacts the tether 128 positioned therebetween as shown in FIG. 5. Because sleeves 100 and tethers 128 are all made of an anti-friction shear material having a low coefficient of friction, as described above, the foam blocks 50 and associated sleeves 100 are able to compress and uncompress with a minimal amount of friction being created by tethers 128. In addition, air bladders 52 are made of an anti-friction shear material having a low coefficient of friction which allows air bladders 52 to compress and uncompress with a minimal amount of friction therebetween. The minimal amount of friction between sleeves 100 and tethers 128 allows each foam block 50 to compress and uncompress individually with minimal interference from adjacent foam blocks 50. Similarly, the minimal amount of friction between air bladders 52 allows each air bladder 52 to compress and uncompress individually with minimal interference from adjacent air bladders 52.

The firmness and support characteristics provided by each foam block 50 depend in part upon the indention load deflection (ILD) of the foam from which each foam block is made. The ILD is a well-known industry-accepted index indicating the "firmness" of material such as urethane foam and other foam rubber materials. The ILD correlates to the amount of force required to compress a piece of foam by twenty-five per cent with an industry standard indenter having a specified area. It is within the scope of the invention as presently perceived to provide core structure 44 in which each foam block 50 has the same ILD or to provide core structure 44 in which the ILD of at least one foam block 50 is different from the ILD of at least one other foam block 50. For example, the ILD's of the foam blocks 50 which support air bladders 52 of respective back, seat, thigh, and foot zones 130, 132, 134, 136 may vary from one another. In addition, it is within the scope of the present invention for each foam block 50 to be comprised of portions having varying ILD's. For example, in one illustrated embodiment, core structure 44 is provided with foam blocks 50 each having firm end portions 138 with an ILD of about forty-four and a soft middle portion 140 with an ILD of about seventeen as shown in FIG. 5. Firm end portions 138 are sized so as to support the respective overlying header bladders 70, 72, 74, 76 to provide mattress structure 30 with more firmness along sides 31 thereof. End portions 138 are bonded to respective middle portions 140 with an adhesive such 30 as, for example, an acetone heptane and resin base spray.

Mattress structure 30 includes a plurality of air tubes 92 that are routed to each header bladder 70, 72, 74, 76 as previously described. Tubes 92 include a first zone tube set 142, a second zone tube set 144, and a third zone tube set 146 as shown in FIG. 3. First zone tube set 142 includes a pressure tube 148 that fluidly couples to one of the back section header bladders 70 and to one of the thigh section header bladders 74. First zone tube set 142 also includes a sensor tube 150 that fluidly couples to the other of the back section header bladders 70. Pressure tube 148 and sensor tube 150 each couple to a single, dual-passage tube connector 152. Second zone tube set 144 includes a pressure tube 154 that fluidly couples to one of the seat section header bladders 72 and a sensor tube 156 that fluidly couples to the other of the seat section header bladders 72. Pressure tube 154 and sensor tube 156 each couple to a single, dual-passage tube connector 158. Third zone tube set 146 includes a pressure tube 160 that fluidly couples to one of the foot section header bladders 76 and a sensor tube 162 that fluidly couples to the other of the foot section header bladders 76. Pressure tube 160 and sensor tube 162 each couple to a single, dual-passage tube connector 164. Layer of material 54 is formed to include a plurality of small slits 166 which define a plurality of pass-through bands 168. Air tubes 92 are routed through slits 166 so that pass-through bands 168 secure air tubes 92 to core structure 44 in the desired routing pattern as shown in FIG. 3.

Figure 6:
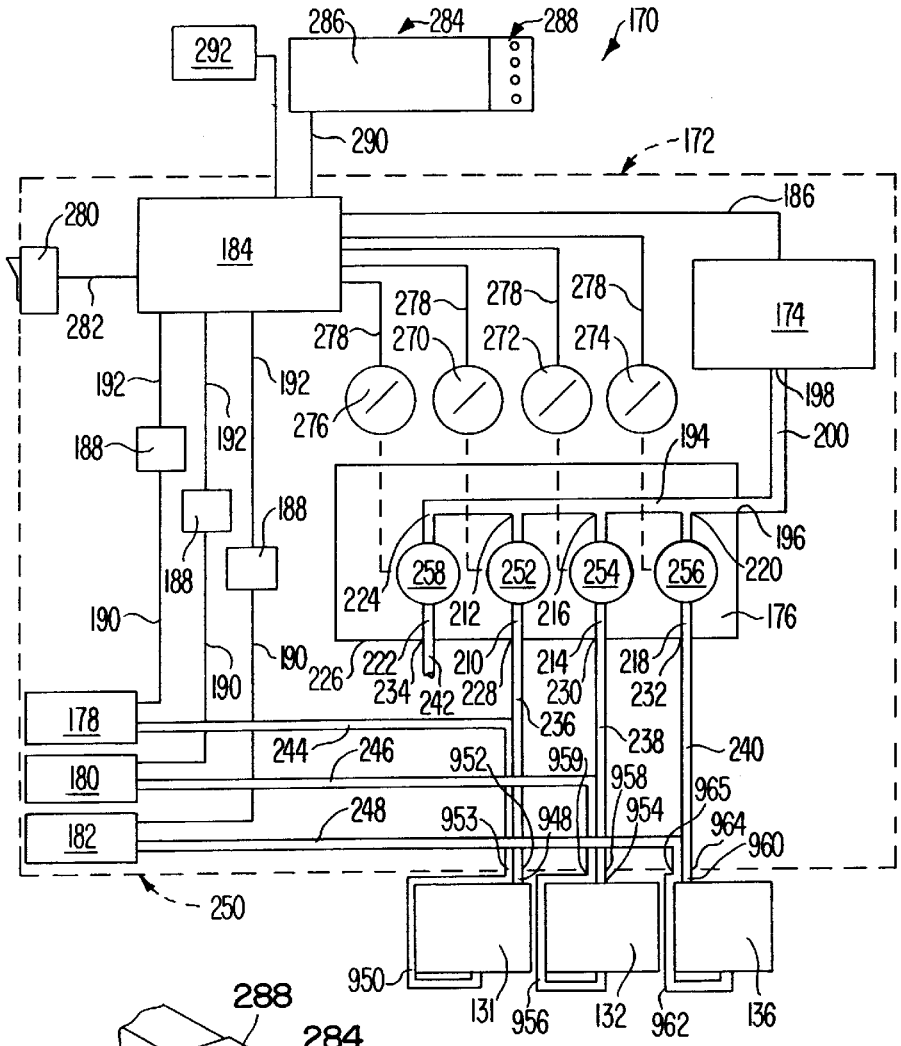
FIG. 6 is a diagrammatic view of an air pressure system that is coupleable to the mattress of FIG. 1 and that is operable to control and adjust pressure in the plurality of air bladders, the air pressure system including user inputs outside and above a dotted line which represents a housing, a microprocessor that receives signals from the user inputs, a manifold, four valves situated in respective manifold passages, a stepper motor coupled to each valve and coupled to the microprocessor, a compressor coupled to the manifold, the manifold being fluidly coupled to three mattress zones shown beneath the housing, and three pressure sensors coupled to respective mattress zones and coupled to the microprocessor through respective analog-to-digital converters.

Because one of the back section header bladders 70 and one of the thigh section header bladders 74 are each fluidly coupled to pressure tube 148, back zone 130 and thigh zone 134 provide mattress structure 30 with a first mattress zone 131 as shown diagrammatically in FIG. 6. Seat zone 132 provides mattress structure 30 with a second mattress zone, hereinafter referred to as either second mattress zone 132 or seat zone 132. In addition, foot zone 136 provides mattress structure 30 with a third mattress zone, hereinafter referred to as either third mattress zone 136 or foot zone 136.

An air pressure system 170, shown diagrammatically in FIG. 6, couples to air tubes 92 and operates to pressurize first, second, and third mattress zones 131, 132, 136. Air pressure system 170 includes a housing 172 that encases the other components of system 170. Air pressure system 170 includes a compressor 174 that operates through a manifold 176 to pressurize mattress zones 131, 132, 136. Air pressure system 170 also includes first, second, and third pressure sensors 178, 180, 182 that sense pressure in first, second, and third mattress zones 131, 132, 136, respectively. Air pressure system 170 includes a microprocessor 184 that provides a control signal to compressor 174 on a control line 186. Each pressure sensor 178, 180, 182 is coupled electrically to a respective analog-to-digital converter 188 via a respective analog signal line 190 and each analog-to-digital converter 188 provides an input signal to microprocessor 184 via a respective digital signal line 192.

Figure 8:
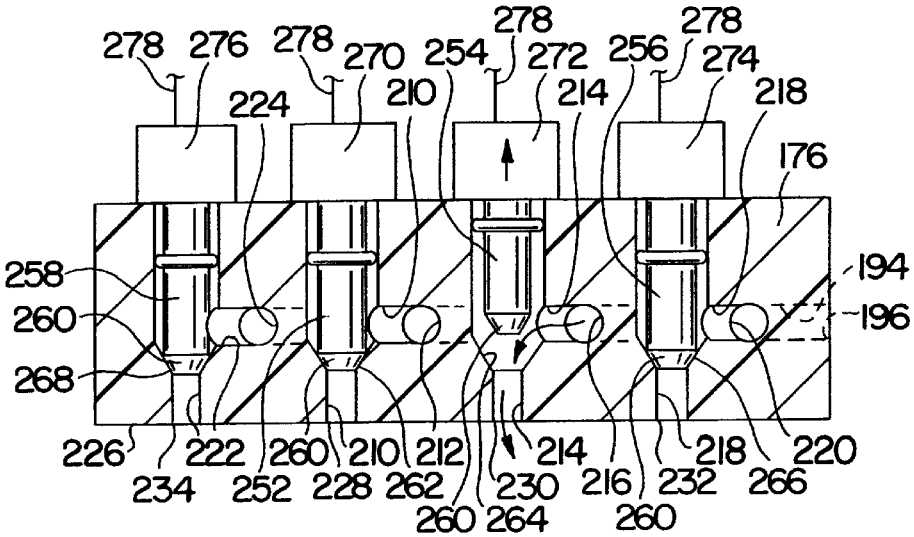
FIG. 8 is a diagrammatic view of the manifold of FIG. 6 showing passages formed in the manifold and showing each valve including a tapered tip that seats against a respective nozzle port of the manifold.

Manifold 176 is formed to include a main passage 194 with an inlet 196 as shown in FIGS. 6 and 8. Compressor 174 includes an outlet 198 that couples to inlet 196 of main passage 194 via a pneumatic hose 200. Manifold 176 is also formed to include a first passage 210 fluidly coupled to main passage 194 at a first port 212, a second passage 214 fluidly coupled to main passage 194 at a second port 216, a third passage 218 fluidly coupled to main passage 194 at a third port 220, and a vent passage 222 fluidly coupled to main passage 194 at a vent port 224 as shown best in FIG. 8. Manifold 176 includes a bottom surface 226 having a first exit port 228 at which first passage 210 terminates, a second exit port 230 at which second passage 214 terminates, a third exit port 232 at which third passage 218 terminates, and a vent exit port 234 at which vent passage 222 terminates as also shown best in FIG. 8.

First passage 210 is fluidly coupled to pressure tube 148 via a first connector hose 236, shown in FIG. 6, that extends from first exit port 228 to dual-passage connector 152. Similarly, second passage 214 is fluidly coupled to pressure tube 154 via a second connector hose 238 that extends from second exit port 230 to dual-passage connector 158 and third passage 218 is fluidly coupled to pressure tube 160 via a third connector hose 240 that extends from third exit port 232 to dual-passage connector 164. In addition, vent passage 222 is fluidly coupled to the atmosphere by a vent hose 242 that extends from vent exit port 234 to an outlet aperture (not shown) formed in housing 172. First pressure sensor 178 is fluidly coupled to sensor tube 150 via a fourth connector hose 244, shown in FIG. 6, that is routed to dual-passage connector 152 alongside first connector hose 236. Similarly, second pressure sensor 180 is fluidly coupled to sensor tube 156 via a fifth connector hose 246 that is routed to dual-passage connector 158 alongside second connector hose 238 and third pressure sensor 182 is fluidly coupled to sensor tube 162 via a sixth connector hose 248 that is routed to dual-passage connector 164 alongside third connector hose 240.

Although hoses 236, 238, 240, 244, 246, 248 are shown diagrammatically in FIG. 6 as being continuous hoses that extend from either manifold 176 or pressure sensors 178, 180, 182 to respective mattress zones 131, 132, 136, it should be understood that hoses 236, 238, 240, 244, 246, 248 are subdivided into segments that connect together with connectors that are like dual-passage connectors 152, 158, 164 or that mate with dual-passage connectors 152, 158, 164. For example, in illustrated embodiments, a set of dual-passage connectors like dual-passage connectors 152, 158, 164 are provided at a bottom panel 250 of housing 172 and a first portion of hoses 236, 238, 240, 244, 246, 248 extend from either manifold 176 or pressure sensors 178, 180, 182 to the set of dual-passage connectors that are like dual-passage connectors 152, 158, 164. In addition, a second portion of hoses 236, 238, 240, 244, 246, 248 extend from the set of dual-passage connectors at bottom panel 250 of housing 172 to dual-passage connectors 152, 158, 164. Both ends of the second portion of hoses 236, 238, 240, 244, 246, 248 are provided with dual-passage connectors that are configured to mate with dual-passage connectors 152, 158, 164.

Air pressure system 170 includes a first valve 252, a second valve 254, a third valve 256, and a vent valve 258 that are situated in passages 210, 214, 218, 222, respectively, of manifold 176, as shown in FIGS. 6 and 8. Valves 252, 254, 256, 258 are each moveable to block and unblock the flow of air through passages 210, 214, 218, 222, respectively. Each valve 252, 254, 256, 258 includes a tapered tip 260 as shown in FIG. 8. In addition, first passage 210 includes a first nozzle port 262 and tapered tip 260 of first valve 252 seats against first nozzle port 262 to block the flow of air through first passage 210. Similarly, second passage 214, third passage 218, and vent passage 222 include a second nozzle port 264, a third nozzle port 266, and a vent nozzle port 268, respectively, against which tapered tips 260 of valves 254, 256, 258 seat. The amount that tapered tips 260 are moved away from respective nozzle ports 262, 264, 266, 268 determines the volume of air that flows through the respective nozzle port 262, 264, 266, 268 at any particular pressure as is well-known in the art.

Air pressure system 170 includes first, second, third, and vent actuators 270, 272, 274, 276 that are coupled mechanically to respective valves 252, 254, 256, 258 as shown in FIGS. 6 and 8. In one illustrated embodiment actuators 270, 272, 274, 276 are each Model No. 26461-12-006 stepper motors manufactured by Haydon Switch and Instruments, Inc. of Waterbury, Conn. and having ratings of 12 V DC and 3.4 W. Each actuator 270, 272, 274, 276 is coupled electrically to microprocessor 184 and receives control signals therefrom via respective signal lines 278. A main power switch 280 is mounted to housing 172 and is coupled to microprocessor 184 via a power line 282. Switch 280 is movable between an ON position in which power is provided from an external power source (not shown) to operate air pressure system 170 and an OFF position in which power is decoupled from air pressure system 170.

Air pressure system 170 includes a weight range selector 284 having a button (not shown) that is pressed to select the weight range of the patient supported by mattress structure 30. Weight range selector 284 is provided with a label 286 having indicia (not shown) specifying the available weight ranges from which to select and a set of LED's 288 that light up to indicate which of the weight ranges is selected currently. The selected weight range is communicated to microprocessor 184 via a data line 290. Air pressure system 170 further includes a run-time meter 292 that is used to track overall run time of air pressure system 170 to provide information for service and maintenance tracking.

Figure 7:
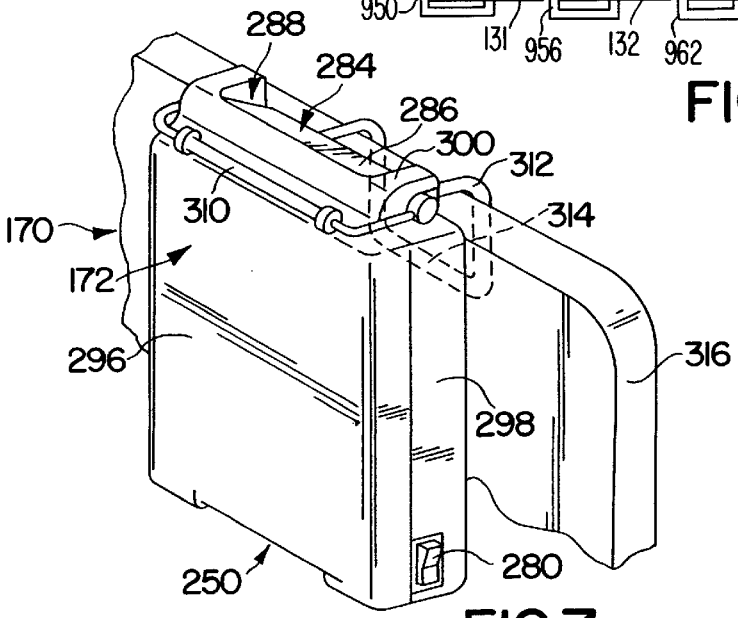
FIG. 7 is a perspective view of the air pressure system of FIG. 6 mounted to an end board of a hospital bed showing three heel-relief knobs on a front panel of the housing, a main power switch on a side panel of the housing, and a weight range selector on a top panel of the housing.

Housing 172, shown best in FIG. 7, includes a front panel 296, a pair of side panels 298, a back panel (not shown), and a top panel 300. Knobs 294 are mounted to front panel 296, run-time meter is mounted to the back panel, and weight range selector 284 is mounted to top panel 300. A carrying handle 310 is mounted to housing 172 and is movable between a storage position, shown in FIG. 7, and an upright carrying position (not shown). In addition, a mounting hook 312 is mounted to housing 172 and is movable between a retracted position (not shown) in which a bight portion 314 of hook 312 is adjacent to the back panel of housing 172 and an extended position, shown in FIG. 7, in which bight portion 314 is spaced apart from the back panel of housing 172, allowing hook 312 to be used to mount air pressure system 170 to another structure such as, for example, a foot board 316 of a hospital bed (not shown).

Microprocessor 184 is operated by a software program that is written so that only one of valves 252, 254, 256 is opened at a time. In addition, the software is written so that air pressure system 170 monitors and, if necessary, adjusts the pressure in each of mattress zones 131, 132, 136 in a cyclical manner. If microprocessor 184 determines that one of mattress zones 131, 132, 136 is below the desired pressure, based on information received from the associated pressure sensor 178, 180, 182, microprocessor 184 sends a signal on the respective signal line 278 to operate the respective actuator 270, 272, 274 to open the associated valve 252, 254, 256 while simultaneously sending a signal on control line 186 to run compressor 174 so that the respective mattress zone 131, 132, 136 is further inflated. If microprocessor 184 determines that one of mattress zones 131, 132, 136 is above the desired pressure, based on information received from the associated pressure sensor 178, 180, 182, microprocessor 184 sends a signal on the respective signal line 278 to operate the respective actuator 270, 272, 274 to open the associated valve 252, 254, 256 and to operate actuator 276 to open vent valve 258 while simultaneously sending a signal on control line 186 to keep the compressor 174 from running so that the respective mattress zone 131, 132, 136 is deflated.

Core structure 44 includes a plurality of vent valves 318, shown in FIGS. 3 and 4, that are each manually opened to fluidly couple a respective one of each of header bladders 70, 72, 74, 76 to the atmosphere which results in rapid deflation of all air bladders 52. In illustrated embodiments, vent valves 318 are VARILITE® release valves, Model No. 04227, and hat flanges Model No. 04226.

Figure 26:
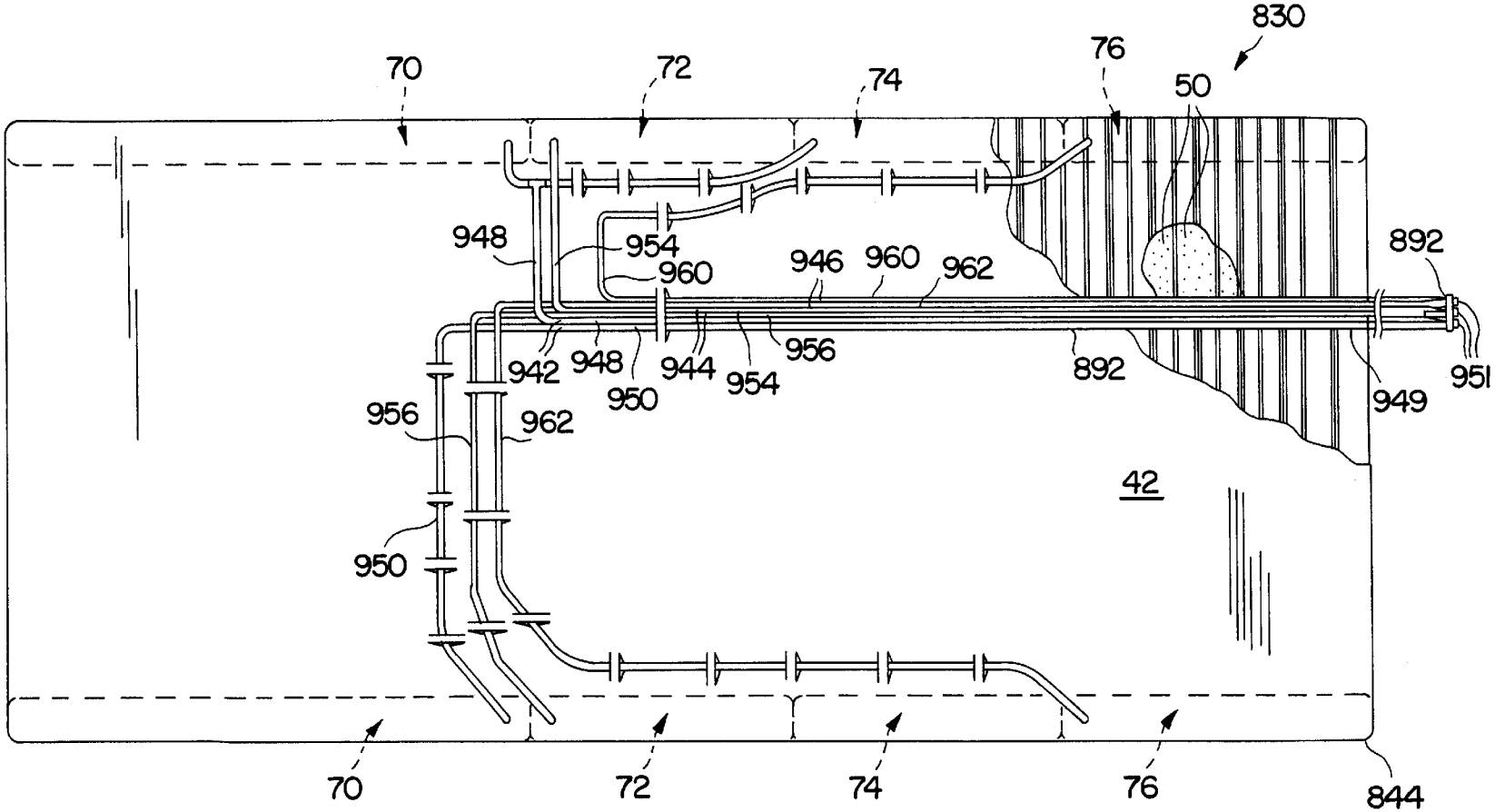
FIG. 26 is a bottom plan view with portions broken away of an alternative embodiment air-over-foam core structure showing the six air passage tubes formed into a tube ribbon over a substantial portion of their lengths with the individual tubes being separated near the point of connection to a connector housing and at the opposite end for communication with the various air bladders.

An alternative embodiment of air-over-foam core 844 for mattress structure 830 is substantially similar to air-over-foam core 44 for mattress structure 30 but does not include vent valves 318. Since alternate embodiment mattress structure 830 is similar to mattress structure 30, like reference numerals are used for like components. Mattress structure 830 includes a plurality of air tubes 892 that are routed to each header bladder 70, 72, 74, 76 as previously described. Tubes 892 include a first zone tube set 942, a second zone tube set 944, and a third zone tube set 946 as shown in FIG. 3. First zone tube set 942 includes a pressure tube 948 that fluidly couples to one of the back section header bladders 70 and to one of the thigh section header bladders 74. First zone tube set 942 also includes a sensor tube 950 that fluidly couples to the other of the back section header bladders 70. Second zone tube set 944 includes a pressure tube 954 that fluidly couples to one of the seat section header bladders 72 and a sensor tube 956 that fluidly couples to the other of the seat section header bladders 72. Third zone tube set 946 includes a pressure tube 960 that fluidly couples to one of the foot section header bladders 76 and a sensor tube 962 that fluidly couples to the other of the foot section header bladders 76. Pressure tube 948, sensor tube 950, pressure tube 954, sensor tube 956, pressure tube 960 and sensor tube 962 are each RF welded or otherwise coupled longitudinally to each other to form a substantially flat multi-lumen tube ribbon 949 extending from interior region 42 of mattress structure 830 to near attachment end of each tube 892. Near attachment end of each tube 892, the tubes 892 forming tube ribbon 949 are separated to allow each tube 892 to be connected to a separate single passage tube connector 951 as shown, for example, in FIGS. 22, 23, and 26.

Tubes 892 connect to air pressure system 170, shown diagrammatically in FIG. 6, which operates to pressurize first, second, and third mattress zones 131, 132, 136, as previously described. First passage 210 is fluidly coupled to pressure tube 948 via a first connector hose 236 that extends from first exit port 228 to single-passage connector 952. Similarly, second passage 214 is fluidly coupled to pressure tube 954 via a second connector hose 238 that extends from second exit port 230 to single-passage connector 958 and third passage 218 is fluidly coupled to pressure tube 960 via a third connector hose 240 that extends from third exit port 232 to single-passage connector 964. In addition, vent passage 222 is fluidly coupled to the atmosphere by a vent hose 242 that extends from vent exit port 234 to an outlet aperture (not shown) formed in housing 172. First pressure sensor 178 is fluidly coupled to sensor tube 950 via a fourth connector hose 244, shown in FIG. 6, that is routed to single-passage connector 953 alongside first connector hose 236. Similarly, second pressure sensor 180 is fluidly coupled to sensor tube 956 via a fifth connector hose 246 that is routed to single-passage connector 959 alongside second connector hose 238 and third pressure sensor 182 is fluidly coupled to sensor tube 962 via a sixth connector hose 248 that is routed to single-passage connector 965 alongside third connector hose 240.

Although hoses 236, 238, 240, 244, 246, 248 are shown diagrammatically in FIG. 6 as being continuous hoses that extend from either manifold 176 or pressure sensors 178, 180, 182 to respective mattress zones 131, 132, 136, it should be understood that hoses 236, 238, 240, 244, 246, 248 may be subdivided into segments that connect together with connectors that are like single-passage connectors 952, 953, 958, 959, 964, 965. For example, in illustrated embodiments, a set of male portions of single-passage connectors 952, 953, 958, 959, 964, 965 are provided at a bottom panel 250 of housing 172 and a first portion of hoses 236, 238, 240, 244, 246, 248 extend from either manifold 176 or pressure sensors 178, 180, 182 to the set of male portions of single-passage connectors 952, 958, 964. In addition, a second portion of hoses 236, 238, 240, 244, 246, 248 extend from the set of female portions of single-passage connectors 952, 953, 958, 959, 964, 965 at bottom panel 250 of housing 172. In the illustrated embodiment, the second portion of hoses 236, 238, 240, 244, 246, 248 includes tubes 892.

To facilitate rapid connection of hoses 236, 238, 240, 246, 248 to tubes 948, 950, 954, 956, 960, 962, the male portions of single passage connectors 952, 953, 958, 959, 964, 965 are held in specific positions in a male connector housing 961 and the female portions of single passage connectors 952, 953, 958, 959, 964, 965 are held in a cooperating specific orientation in female connector housing 963 forming a quick-disconnect assembly 947, as shown for example in FIGS. 22–25. Male connector housing 961 is attached to the bottom panel 250 of housing 172 of air pressure system 170 and internally connected to hoses 236, 238, 240, 244, 246, 248. Female connector housing 963 is coupled to attachment ends of tubes 948, 950, 954, 956, 960, 962.

Figure 22:
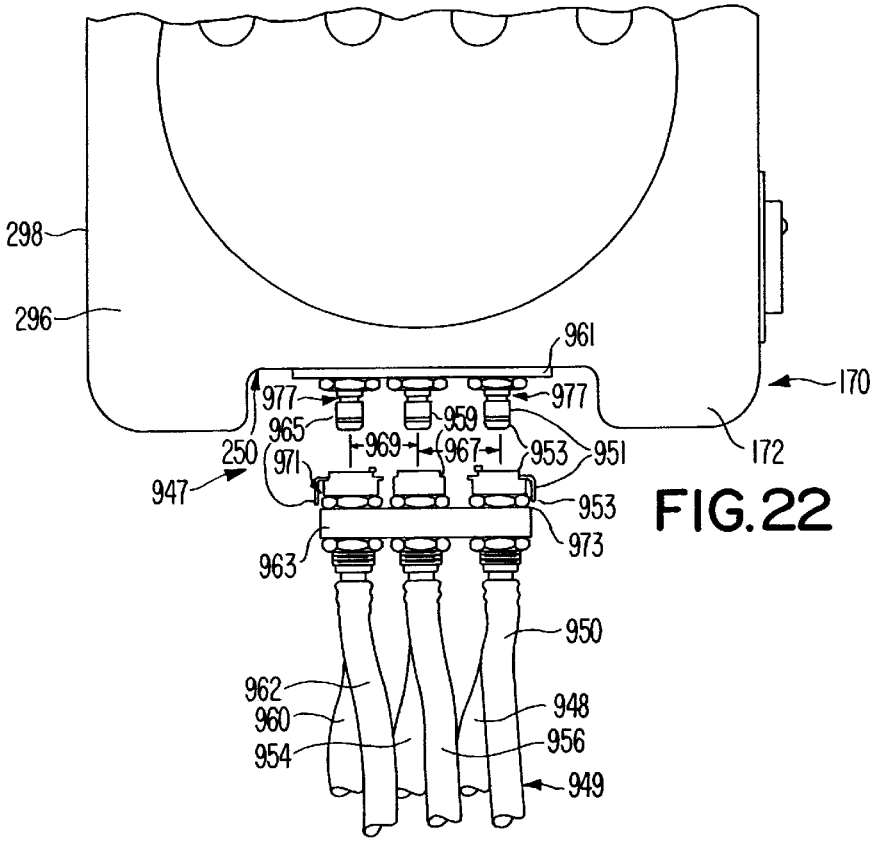
FIG. 22 is a partial front plan view of a controller quick disconnect showing a controller unit having six male connector portions and a controller tube connector having six female connector portions in fluid communication with six tubes with the male and female connector portions each secured within a male connector housing and a female connector housing respectively which properly position the twelve connector portions for simultaneous coupling and decoupling to form six connectors.
Figure 23:
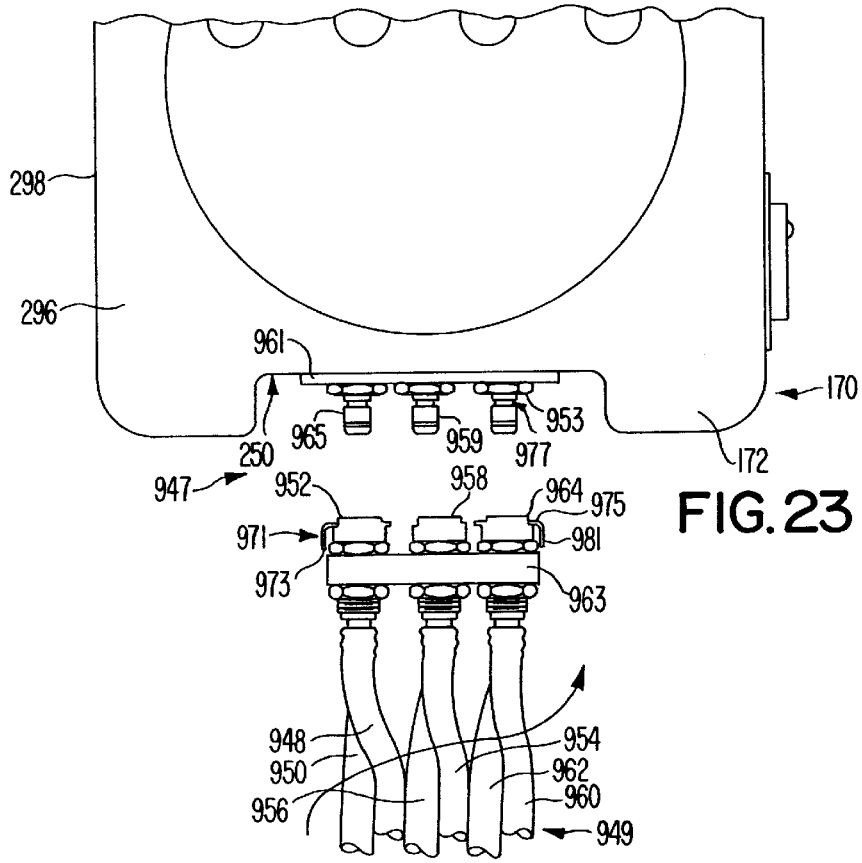
FIG. 23 is a partial front plan view of the controller quick disconnect of FIG. 22 with the female connector housing rotated 180 degrees so that the female connector portions no longer align with the male connector portions prohibiting simultaneous coupling.
Figure 24:
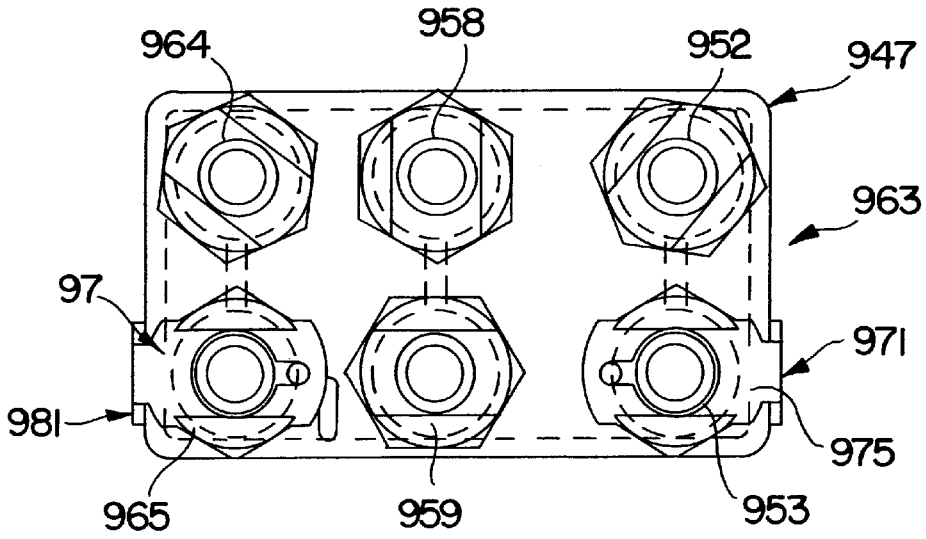
FIG. 24 is a top plan view of the female connector housing of FIG. 22 showing the six female connector portions.
Figure 25:
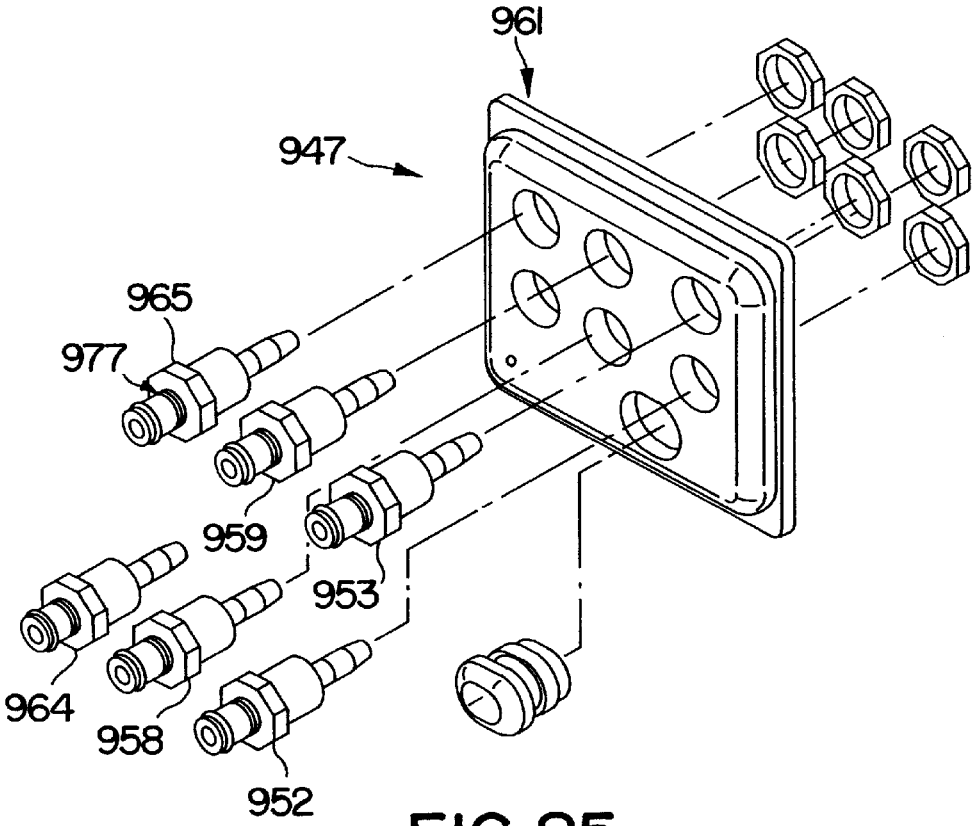

In the illustrated embodiment, female portions of connectors 953, 959, 965, coupled to the three sensor tubes 950, 956, 962, are aligned longitudinally with respect to each other and are off-set laterally from female portions of connectors 952, 958, 964, coupled to the three pressure tubes 948, 954, 960, which are aligned longitudinally with respect to each other, as shown for example in FIG. 22. Female portions of sensor connectors 953 and 959 are longitudinally displaced from each other by a displacement 967 as are female portions of pressure connectors 952 and 958. Female portions of sensor connectors 959 and 965 are longitudinally displace from each other by a displacement 969 as are female portions of pressure connectors 958 and 964. Likewise male portions of connectors 953, 959, 965, coupled to the three sensor hoses 244, 246, 248, are aligned longitudinally with respect to each other and are off-set laterally from male portions of connectors 952, 958, 964, coupled to the three pressure hoses 236, 238, 240, which are aligned longitudinally with respect to each other, as shown, for example, in FIG. 22. Male portions of sensor connectors 953 and 959 are longitudinally displaced from each other by a displacement 967 as are male portions of pressure connectors 952 and 958. Male portions of sensor connectors 959 and 965 are longitudinally displace from each other by a displacement 969 as are male portions of pressure connectors 958 and 964. Displacement 967 differs from displacement 969 so that the male and female portions of all six connectors 952, 953, 958, 959, 964, 965 can be simultaneously coupled only when oriented so that cooperating tubes and hoses mate.

In the illustrated embodiments the male portions of connectors 952, 953, 958, 959, 964, 965 are male portions of single passage connectors available from Colder Products Corporation As part number PMCX 42-03. Female portions of connectors 952, 958, 959, 964 are female portions of single passage connectors available from Colder Products Corporation as part number PMCX 16-04-NC.

The female portions of the two front end connectors 953, 965 include a latching mechanism 971 including a spring 973 which urges a latch plate 975 ("the snap-fit hardware") into channel 977 of male connector portion to secure the connectors in a connected state (not shown). Latch plate 975 includes and actuator 981 against which spring 973 pushes to bias the plate 975 in the channel engaging position. By concurrently pushing on both actuators 981 to compress springs 973, a user can position latch plates 975 so that they do not engage channels 977 facilitating decoupling of male and female portions of connectors 952, 953, 958, 959, 964, 965. In the illustrated embodiment female portions of connectors 953, 965 are available from Colder Products Corporation as part number PMCX 16-04. Both connectors 953 and 965 are sensor connectors and thus are positioned on the ends of the front row of connectors in the female connector housing 963 facilitating access to the actuators 981 by a health care provider. The snap-fit hardware also provides a visual indicator of the proper orientation of the female connector housing 963 aiding in quickly orienting the housing 963 for connection to the male connector housing 961. When the male portion of each connector 952, 953, 958, 959, 964, 965 is properly seated in the female portion of connector 952, 953, 958, 959, 964, 965 the snap-fit hardware produces an audible click. Thus the illustrated embodiment provides a quick-connect/quick-disconnect between the mattress structure and the air supply.

The quick-connect/quick-disconnect between mattress and air supply allows for rapid deflation of the air bladders without the need for additional vent valves 318. In the illustrated embodiment disconnection of the female connector housing 963 from the male connector housing 961 immediately vents first zone tube set 942 to the atmosphere through tubes 948 and 950, second zone tube set 944 to the atmosphere through tubes 954 and 956, and third zone tube set 946 to the atmosphere through tubes 960 and 962. While described as elements of mattress structure 830 used in conjunction with air supply 170, it should be understood that tube ribbon 949, male connector housing 961 and female connector housing 963 are easily adaptable for use with any of the disclosed mattress structures or air supplies.

It is within the scope of the invention as presently perceived for microprocessor 184 of air pressure system 170 to execute any one of a number of air pressure control algorithms to control the air pressure within zones 131, 132, 136. For example, a block diagram of one algorithm that may be executed by microprocessor 184 to control the air pressure within zones 131, 132, 136 is shown in FIGS. 9*a* and 9*b* and a set of block diagrams of another algorithm that may be executed by microprocessor 184 to control the air pressure within zones 131, 132, 136 is shown in FIGS. 16, 17*a*, 17*b*, 18*a*, and 18*b*.

Figure 9A:
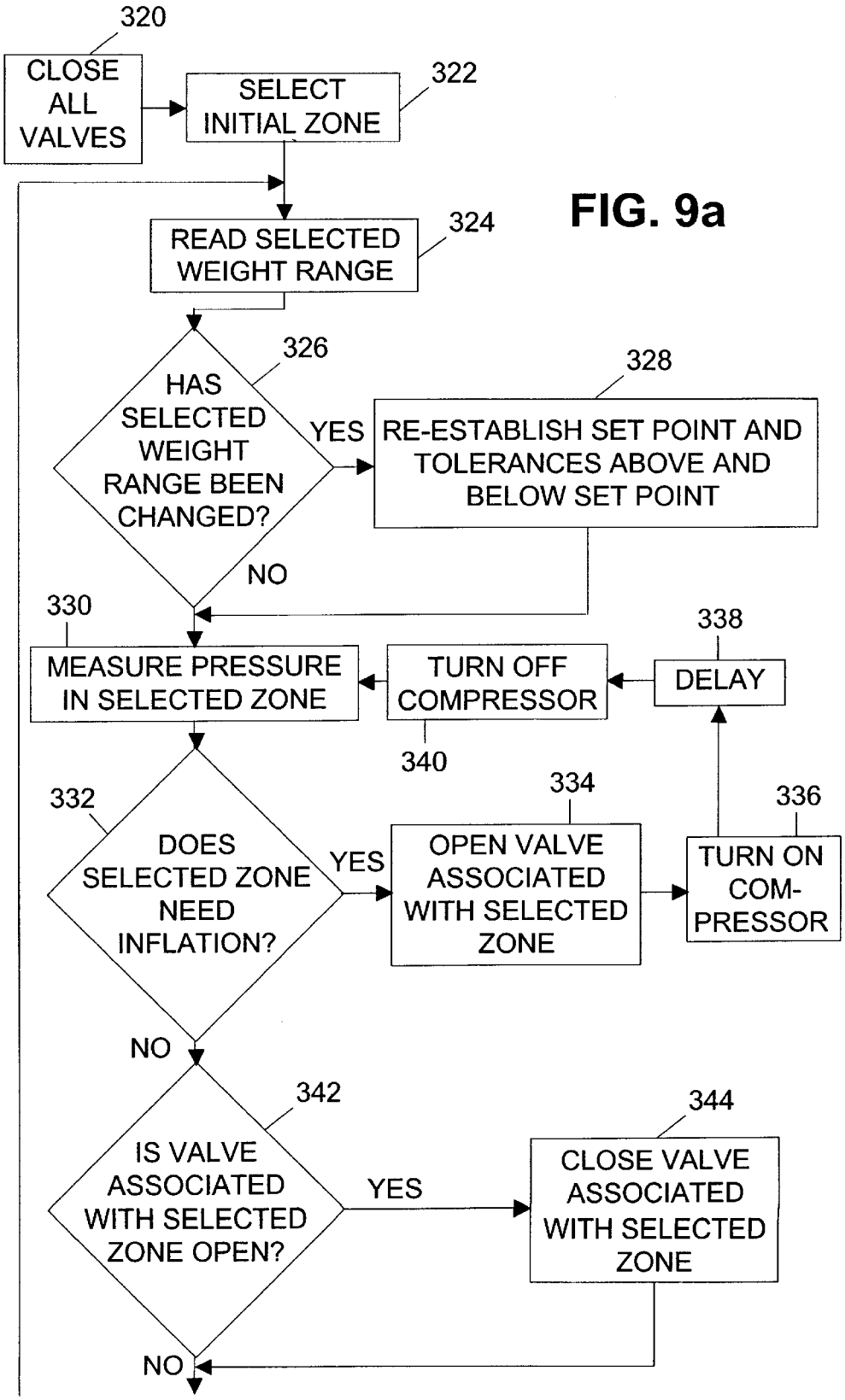
FIG. 9*a* is a first portion of a flow diagram showing some of the steps performed by the air pressure system of FIG. 6.
Figure 9B:
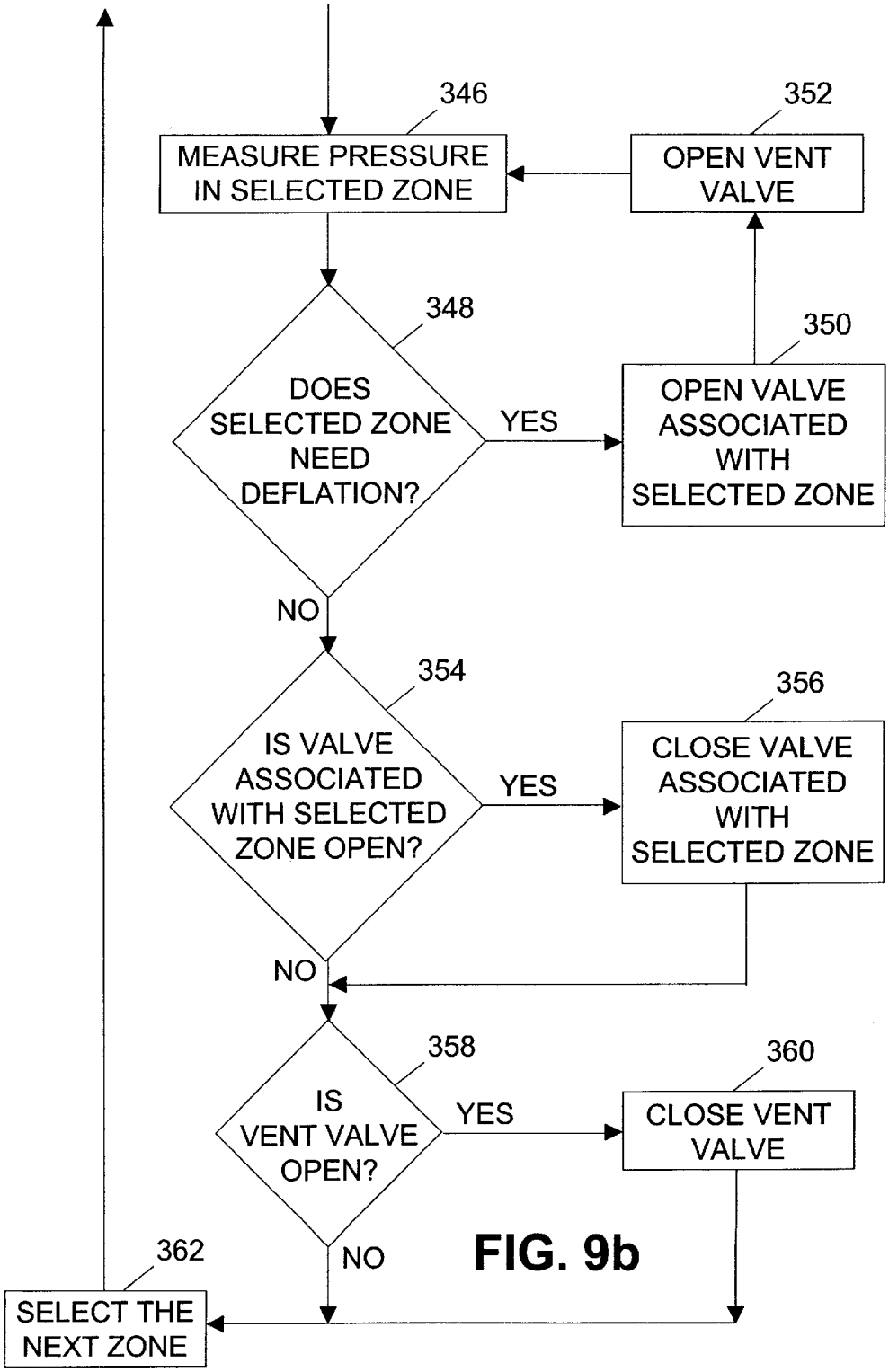
FIG. 9*b* is a second portion of a flow diagram showing some of the steps performed by the air pressure system of FIG. 6.

FIGS. 9*a* and 9*b* show a flow chart of the steps performed by microprocessor 184 of air pressure system 170 as one possible software program is executed as previously mentioned. The first step performed by microprocessor 184 is to send signals on lines 278 to actuators 270, 272, 274, 276 to close all of valves 252, 254, 256, 258 as indicated at block 320 of FIG. 9*a*. In addition, compressor 174 is off when microprocessor 184 first begins executing the software program. The next step performed by microprocessor 184 is to select the initial mattress zone to be monitored for possible pressure adjustment as indicated at block 322. The initial zone can be any one of mattress zones 131, 132, 136, but typically, the initial zone is programmed to be mattress zone 131. After the initial zone has been selected, microprocessor 184 reads the weight range selected by the user with weight range selector 284 as indicated at block 324.

After reading the selected weight range, microprocessor 184 determines whether the selected weight range has been changed as indicated at block 326 of FIG. 9*a*. If the selected weight range has been changed, microprocessor 184 will re-establish a pressure set point and the tolerances above and below the set point as indicated at block 328. It should be understood that when the software program is executed the first time after air pressure system 170 is powered up, the selected weight range will be considered to be a new weight range by microprocessor 184.

The set points are the target pressures to be maintained in each of mattress zones 131, 132, 136 based on the weight range selected by the user and the tolerances are the ranges above and below the target pressure that are considered to be adequate for patient support. For example, when a heavy person is supported on mattress structure 30, a higher weight range should be selected with selector 284 so that relatively high pressure set points and associated tolerances are established for each of mattress zones 131, 132, 136 and when a light person is supported on mattress structure 30, a lower weight range should be selected with selector 284 so that relatively low pressure set points and associated tolerances are established for each of mattress zones 131, 132, 136. It is within the scope of the invention as presently perceived for the set points established for each mattress zone 131, 132, 136 to be different than the set points established for each of the other mattress zones 131, 132, 136 and it is also within the scope of the invention as presently perceived for the set points established for two or more of mattress zones 131, 132, 136 to be substantially equivalent.

After the pressure set points and tolerances are re-established at block 328 or if the selected weight range has not been changed as determined at block 326, microprocessor 184 reads the value of the pressure in the selected mattress zone 131, 132, 136 which is communicated to microprocessor 184 from the associated pressure sensor 178, 180, 182 as indicated at block 330 of FIG. 9*a*. After reading the pressure of the selected mattress zone 131, 132, 136, microprocessor 184 determines whether the selected mattress zone 131, 132, 136 needs inflation as indicated at block 332. Microprocessor 184 makes the determination at block 332 by comparing the value of pressure read at block 330 with a low-limit pressure which is calculated based on the set point and tolerance established at block 328. If the pressure in the selected mattress zone 131, 132, 136 is below the low-limit pressure, then the selected mattress zone 131, 132, 136 needs inflation.

If microprocessor 184 determines at block 332 that the selected mattress zone 131, 132, 136 needs inflation, microprocessor 184 then sends a signal on one of signal lines 278 to actuate the actuator 270, 272, 274 associated with the selected mattress zone 131, 132, 136 to open the respective valve 252, 254, 256 by one step as indicated at block 334. After the valve 252, 254, 256 associated with the selected mattress zone 131, 132, 136 is opened by one step at block 334, microprocessor 184 then sends a signal on line 186 to run compressor 174 as indicated at block 336. Compressor 174 is run for a predetermined delay period, as indicated at block 338, and then microprocessor 184 sends a signal on line 186 to stop running compressor 174 as indicated at block 340. After compressor 174 is turned off at block 340, microprocessor 184 takes another pressure reading from the pressure sensor 178, 180, 182 associated with the selected mattress zone 131, 132, 136 as indicated at block 330.

After microprocessor 184 takes another pressure reading at block 330, microprocessor then determines whether further inflation of the selected mattress zone 131, 132, 136 is needed as indicated at block 332. If inflation is still needed, microprocessor then loops through blocks 334, 336, 338, 340 and back to block 330. Microprocessor 184 will loop through blocks 330, 334, 336, 338, 340 as many times as required until the selected mattress zone 131, 136 no longer needs inflation. Each time microprocessor 184 loops through blocks 330, 334, 336, 338, 390, the valve 252, 254, 256 associated with the selected mattress zone 131, 132, 136 is opened by one additional step. Thus, if the selected mattress zone 131, 132, 136 needs a small amount of inflation, the associated valve 252, 254, 256 will be stepped open by a small amount and if the selected mattress zone 131, 132, 136 needs a large amount of inflation, the associated valve 252, 254, 256 will be stepped open by a large amount. This "step-measure" process results in controlled inflation of the selected mattress zone 131, 132, 136.

If microprocessor 184 determines at block 332 that the selected mattress zone 131, 132, 136 does not need inflation, microprocessor 184 then determines if the valve 252, 254, 256 associated with the selected mattress zone 131, 132, 136 is open as indicated at block 342. If the valve 252, 254, 256 associated with the selected mattress zone 131, 132, 136 is open, which will be the case if microprocessor 184 has looped through blocks 334, 336, 338, 340 one or more times, then microprocessor 184 sends a signal on the appropriate signal line 278 to the actuator 270, 272, 274 associated with the selected mattress zone 131, 132, 136 to close the respective valve 252, 254, 256 at a fast rate.

After the valve 252, 254, 256 associated with the selected mattress zone 131, 132, 136 is closed at block 344 or if microprocessor 184 determines at block 342 that the valve 252, 254, 256 associated with the selected mattress zone 131, 132, 136 is not open, microprocessor 184 reads the value of the pressure in the selected mattress zone 131, 132, 136 which is communicated to microprocessor 184 from the associated pressure sensor 178, 180, 182 as indicated at block 346 of FIG. 9*b*. After reading the pressure of the selected mattress zone 131, 132, 136, microprocessor 184 determines whether the selected mattress zone 131, 132, 136 needs deflation as indicated at block 348. Microprocessor 184 makes the determination at block 348 by comparing the value of pressure read at block 346 with a high-limit pressure which is calculated based on the set point and tolerance established at block 328. If the pressure in the selected mattress zone 131, 132, 136 is above the high-limit pressure, then the selected mattress zone 131, 132, 136 needs deflation.

If microprocessor 184 determines at block 348 that the selected mattress zone 131, 132, 136 needs deflation, microprocessor 184 then sends a signal on one of signal lines 278 to actuate the actuator 270, 272, 274 associated with the selected mattress zone 131, 132, 136 to open the respective valve 252, 254, 256 by one step as indicated at block 350. After the valve 252, 254, 256 associated with the selected mattress zone 131, 132, 136 is opened by one step at block 334, microprocessor 184 then sends a signal on the appropriate line 278 to vent actuator 276 to open vent valve 258 by one step as indicated at block 352. After the valve 252, 254, 256 associated with the selected mattress zone 131, 132, 136 is stepped open and after vent valve 258 is stepped open, microprocessor 184 takes another pressure reading as indicated at block 346.

After microprocessor 184 takes another pressure reading at block 346, microprocessor 184 then determines whether further deflation is needed as indicated at block 348. If deflation is still needed, microprocessor 184 then loops through blocks 350, 352 and back to block 346. Microprocessor 184 loops through blocks 346, 348, 350, 352 as many times as required until the selected mattress zone 131, 136 no longer needs deflation. Each time microprocessor 184 loops through blocks 346, 348, 350, 352, the valve 252, 254, 256 associated with the selected mattress zone 131, 132, 136 and vent valve 258 are both opened by one additional step. Thus, if the selected mattress zone 131, 132, 136 needs a small amount of deflation, the associated valve 252, 254, 256 and vent valve 258 will both be stepped open by a small amount and, if the selected mattress zone 131, 132, 136 needs a large amount of deflation, the associated valve 252, 254, 256 and vent valve 258 will both be stepped open by a large amount. This "step measure" process results in controlled deflation of the selected mattress zone 131, 132, 136.

If microprocessor 184 determines at block 348 that the selected mattress zone 131, 132, 136 does not need deflation, microprocessor 184 then determines if the valve 252, 254, 256 associated with the selected mattress zone 131, 132, 136 is open as indicated at block 354. If the valve 252, 254, 256 associated with the selected mattress zone 131, 132, 136 is open, which will be the case if microprocessor 184 has looped through blocks 350, 352 one or more times, microprocessor 184 sends a signal on the appropriate signal line 278 to the actuator 270, 272, 274 associated with the selected mattress zone 131, 132, 136 to close the respective valve 252, 254, 256 at a fast rate as indicated at block 356.

After the valve 252, 254, 256 associated with the selected mattress zone 131, 132, 136 has been closed at a fast rate or if the valve 252, 254, 256 associated with the selected mattress zone 131, 132, 136 is not open, microprocessor 184 determines whether vent valve 258 is open as indicated at block 358 of FIG. 9*b*. If vent valve 258 is open, which will be the case if microprocessor 184 has looped through blocks 350, 352 one or more times, microprocessor 184 sends a signal on the appropriate signal line 278 to actuator 276 to close vent valve 258 at a fast rate as indicated at block 360. After vent valve 258 has been closed at a fast rate or if vent valve 258 is not open, microprocessor 184 then selects the next mattress zone 131, 132, 136 as indicated at block 362. The next mattress zone 131, 132, 136 selected at block 362 can be either of the two mattress zones 131, 132, 136 that were not selected previously. For example, if mattress zone 131 was the mattress zone selected initially, then either of mattress zones 132, 136 can be the next selected mattress zone. After the next mattress zone 131, 132, 136 is selected, microprocessor 184 loops through the software program again, beginning with block 324 of FIG. 9*a*.

Thus, mattress structure 30 includes air bladders 52 that are grouped into sets comprising mattress zones 131, 132, 136 and air pressure system 170 includes microprocessor 184, manifold 174, actuators 270, 272, 274, 276, and valves 252, 254, 256, 258 that comprise a bladder set selector. The air bladder sets comprising zones 131, 132, 136 are selected in a cyclical manner and the bladder set selector operates to fluidly couple the selected bladder set to either the atmosphere, if the selected bladder set needs deflation, or to the compressor, if the selected bladder set needs inflation. The unselected bladder sets remain fluidly decoupled from the compressor and fluidly decoupled from the atmosphere.

Figure 10:
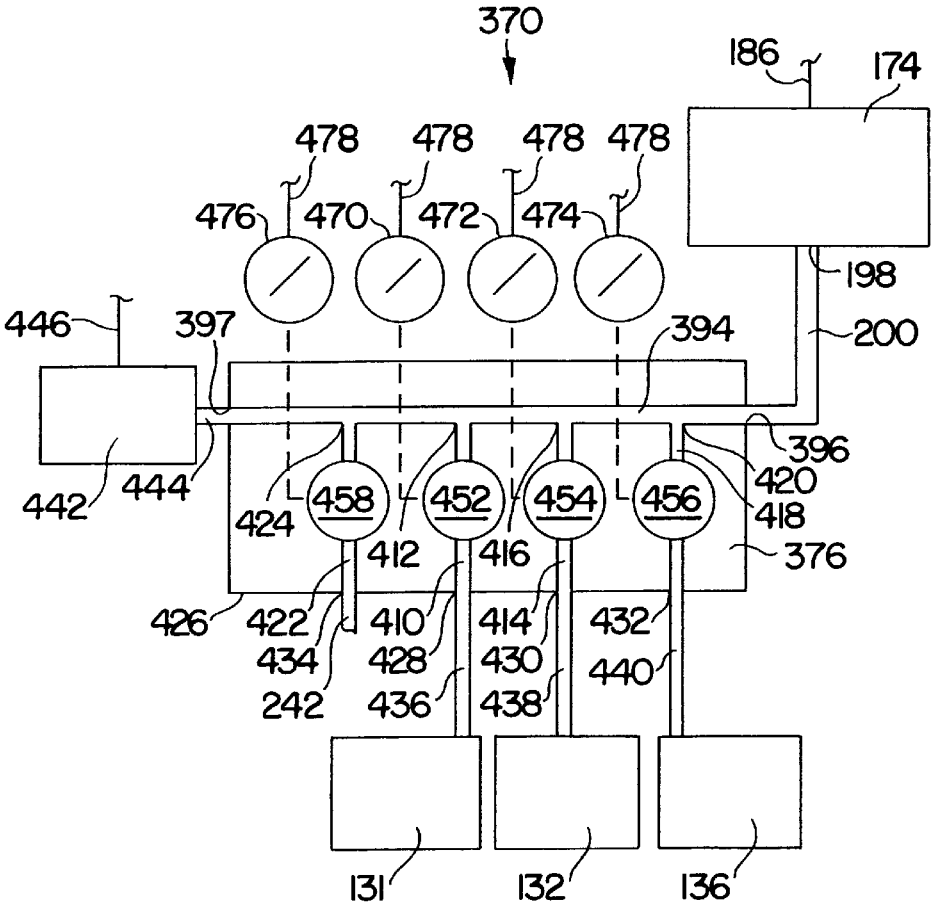
FIG. 10 is a diagrammatic view of a portion of an alternative embodiment air pressure system that is coupleable to the mattress of FIG. 1 and that is operable to control and adjust pressure in the plurality of air bladders, the alternative embodiment air pressure system including a manifold, four valves situated in respective manifold passages, a stepper motor coupled to each valve, a compressor coupled to the manifold, the manifold being fluidly coupled to three mattress zones shown beneath the manifold, and a single pressure sensor coupled to the manifold.

A portion 370 of an alternative embodiment air pressure system which can be used to adjust the pressure in mattress zones 131, 132, 136 is shown in FIG. 10. The alternative embodiment air pressure system is similar to air pressure system 170 and therefore, like reference numerals are used for like components. For example, portion 370 of the alternative embodiment air pressure system includes compressor 174 that receives control signals on control line 186 from a microprocessor (not shown) that is substantially similar to microprocessor 184 of air pressure system 170. Portion 370 includes a manifold 376 having a main passage 394 with an inlet 396 and an outlet 397 as shown in FIG. 10. Compressor 174 includes an outlet 198 that couples to inlet 396 of manifold 376 via a pneumatic hose 200.

Manifold 376 is formed to include a first passage 410 fluidly coupled to main passage 394 at a first port 412, a second passage 414 fluidly coupled to main passage 394 at a second port 416, a third passage 418 fluidly coupled to main passage 394 at a third port 420, and a vent passage 422 fluidly coupled to main passage 394 at a vent port 424 as shown in FIG. 10. Manifold 376 includes a bottom surface 426 having a first exit port 428 at which first passage 410 terminates, a second exit port 430 at which second passage 414 terminates, a third exit port 432 at which third passage 418 terminates, and a vent exit port 434 at which vent passage 422 terminates as also shown in FIG. 10.

First passage 410 is fluidly coupled to first mattress zone 131 via a first connector hose 436 that extends from first exit port 428 to a single-passage connector (not shown) associated with first mattress zone 131. Similarly, second passage 414 is fluidly coupled to second mattress zone 132 via a second connector hose 438 that extends from second exit port 430 to a single-passage connector (not shown) associated with second mattress zone 132 and third passage 418 is fluidly coupled to third mattress zone 136 via a third connector hose 440 that extends from third exit port 432 to a single-passage connector (not shown) associated with third mattress zone 136. In addition, vent passage 422 is fluidly coupled to the atmosphere by a vent hose 242 that extends from vent exit port 434 to an outlet aperture (not shown) formed in a housing (not shown) that contains portion 370 of the alternative embodiment air pressure system.

Although hoses 436, 438, 440 are shown diagrammatically in FIG. 10 as being continuous hoses that extend from manifold 376 to respective mattress zones 131, 132, 136, it should be understood that hoses 436, 438, 440 could be subdivided into segments as was the case with hoses 236, 238, 240, 244, 246, 248 of air pressure system 170. For example, each of hoses 436, 438, 440 preferably includes first and second portions that connect together with respective single passage connectors (not shown).

Portion 370 of the alternative embodiment air pressure system includes a first valve 452, a second valve 454, a third valve 456, and a vent valve 458 that are situated in passages 410, 414, 418, 422, respectively, as shown in FIG. 10. Valves 452, 454, 456, 458 are each moveable to block and unblock the flow of air through passages 410, 414, 418, 422, respectively. Portion 370 of the alternative embodiment air pressure system also includes first, second, third, and vent actuators 470, 472, 474, 476 that are coupled mechanically to respective valves 452, 454, 456, 458 as shown in FIG. 10. In addition, each actuator 470, 472, 474, 476 is coupled electrically to the microprocessor of the alternative embodiment air pressure system and receives control signals therefrom via respective signal lines 478. Actuators 470, 472, 474, 476 and valves 452, 454, 456, 458 of portion 370 are substantially similar to actuators 270, 272, 274, 276 and valves 252, 254, 256, 258 of air pressure system 170.

Portion 370 of the alternative embodiment air pressure system includes a single pressure sensor 442 that fluidly communicates with main passage 394 via a sensor connector hose 444 that extends from outlet 397 of manifold 376 to pressure sensor 442 as shown in FIG. 10. Pressure sensor 442 communicates pressure data on an analog signal line 446 to the microprocessor of the alternative embodiment air pressure system through an analog-to-digital converter (not shown) that is substantially similar to the analog-to-digital converters 188 of air pressure system 170. When compressor 174 is in the off state and when one of valves 452, 454, 456 is opened, pressure sensor 442 is in fluid communication with the mattress zone 131, 132, 136 associated with the opened valve 452, 454, 456 and is, therefore, able to sense the pressure of the mattress zone 131, 132, 136 associated with the opened valve 452, 454, 456.

The microprocessor of the alternative embodiment air pressure system, hereinafter referred to as microprocessor 184 is operated by a software program that is written so that only one of valves 452, 454, 456 is opened at a time. In addition, the software program is written so that the alternative embodiment air pressure system monitors and, if necessary, adjusts the pressure in each of mattress zones 131, 132, 136 in a cyclical manner. Microprocessor 184 sends a signal on one of lines 478 to open a selected one of valves 452, 454, 456 so that pressure sensor 442 can read the pressure of a selected mattress zone 131, 132, 136. If microprocessor 184 determines that one of mattress zones 131, 132, 136 is below the desired pressure, based on information received from pressure sensor 442, microprocessor 184 sends a signal on the respective signal line 478 to operate the respective actuator 470, 472, 474 to step open the associated valve 452, 454, 456 while simultaneously sending a signal on control line 186 to run compressor 174 so that the respective mattress zone 131, 132, 136 is further inflated. If microprocessor 184 determines that one of mattress zones 131, 132, 136 is above the desired pressure, based on information received from pressure sensor 442, microprocessor 184 sends a signal on the respective signal line 478 to operate the respective actuator 470, 472, 474 to step open the associated valve 452, 454, 456 and to operate actuator 476 to step open vent valve 458 while simultaneously sending a signal on control line 186 to keep the compressor 174 from running so that the respective mattress zone 131, 132, 136 is deflated.

Figure 11A:
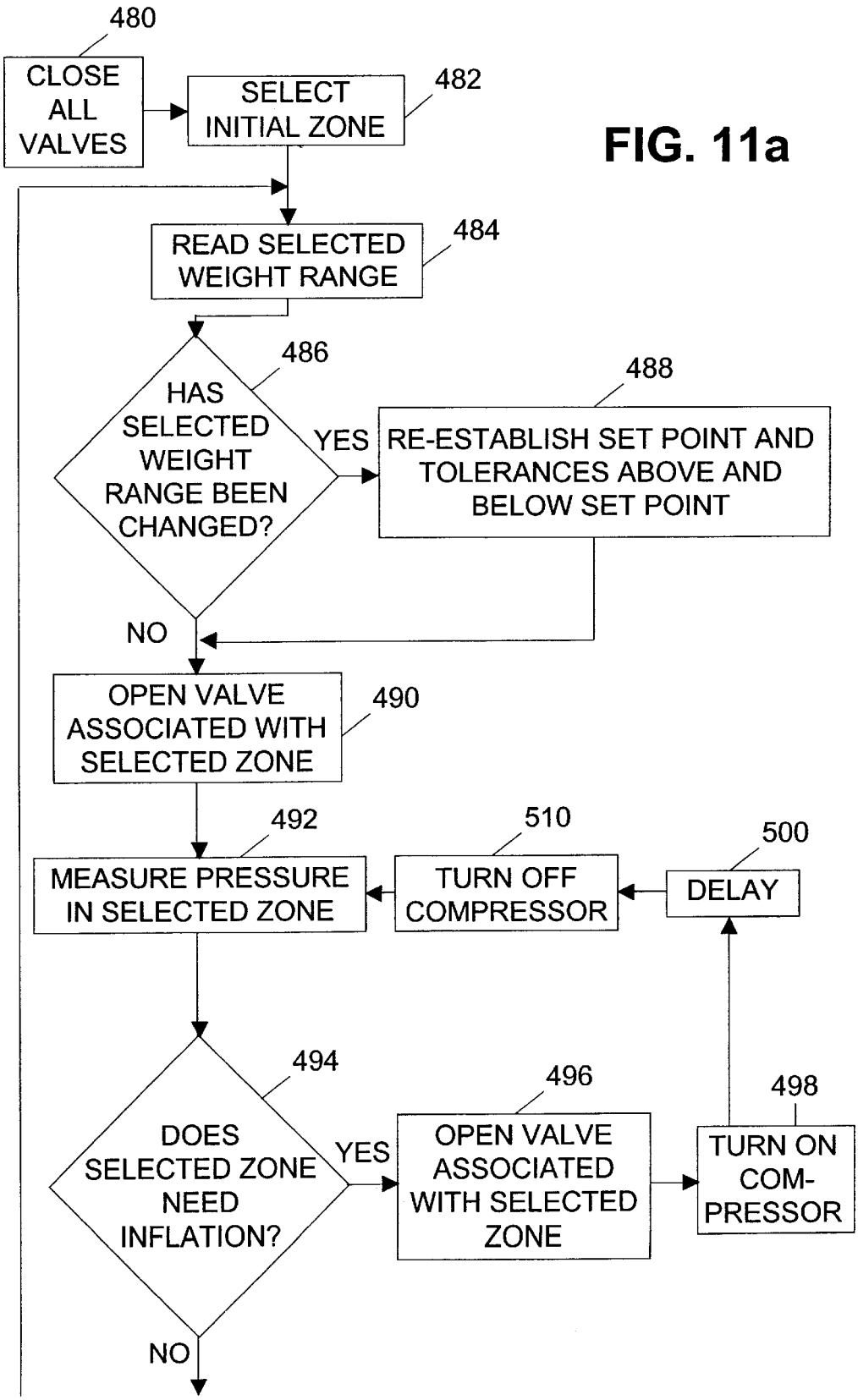
FIG. 11*a* is a first portion of a flow diagram showing some of the steps performed by the air pressure system containing the components of FIG. 10.
Figure 11B:
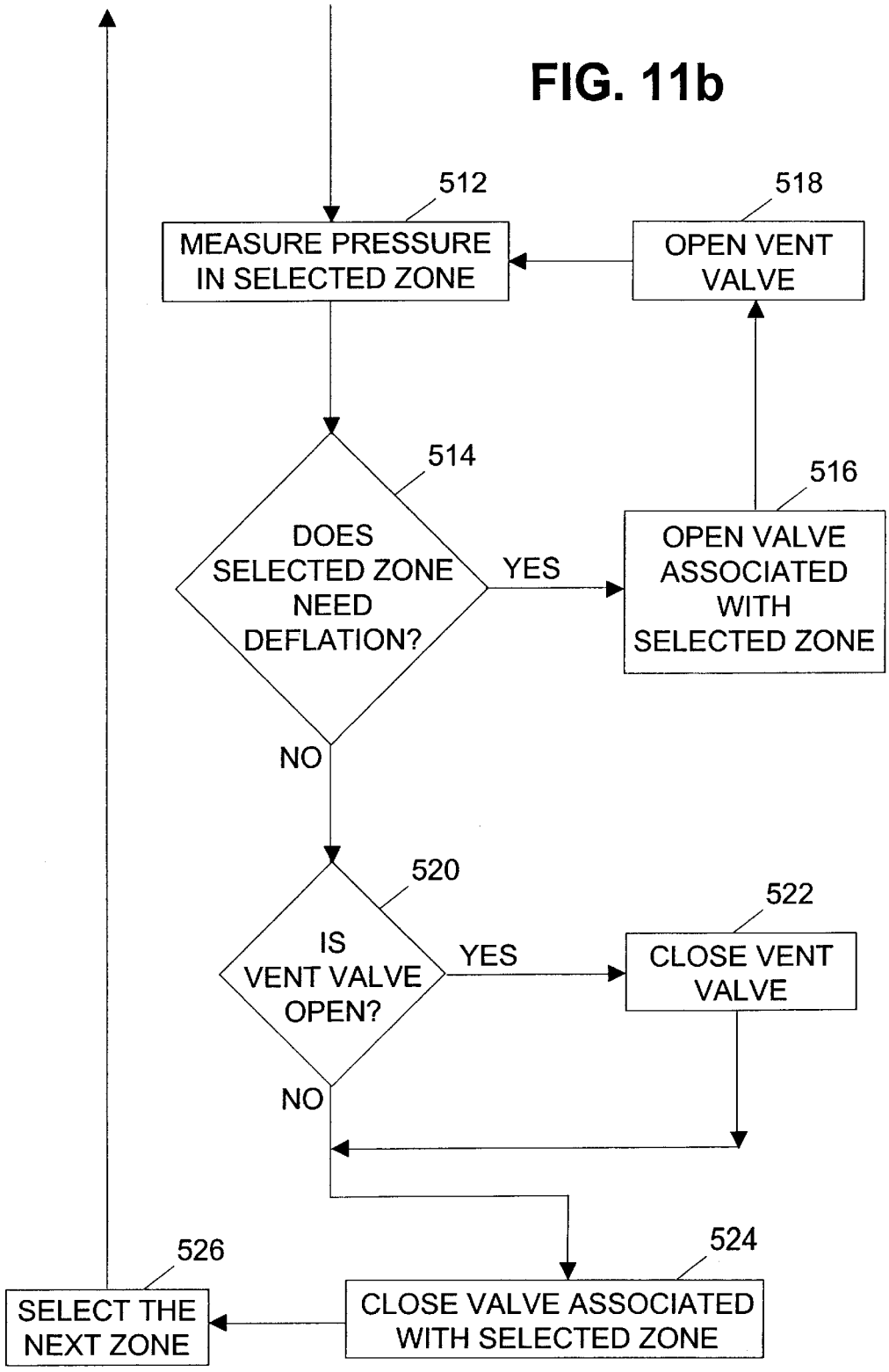
FIG. 11*b* is a second portion of a flow diagram showing some of the steps performed by the air pressure system containing the components of FIG. 10.

FIGS. 11*a* and 11*b* show a flow chart of the steps performed by microprocessor 184 of the alternative embodiment air pressure system as the software program is executed. The first step performed by microprocessor 184 is to send signals on lines 478 to actuators 470, 472, 474, 476 to close all of valves 452, 454, 456, 458 as indicated at block 480 of FIG. 11*a*. In addition, compressor 174 is off when microprocessor 184 first begins executing the software program. The next step performed by microprocessor 184 is to select the initial mattress zone to be monitored for possible pressure adjustment as indicated at block 482. The initial zone can be any one of mattress zones 131, 132, 136, but typically, the initial zone is programmed to be mattress zone 131. After the initial mattress zone 131, 132, 136 has been selected, microprocessor 184 reads the weight range selected by the user with a weight range selector of the alternative embodiment air pressure system as indicated at block 484.

After reading the selected weight range, microprocessor 184 determines whether the selected weight range has been changed as indicated at block 486 of FIG. 11*a*. If the selected weight range has been changed, microprocessor 184 will re-establish a pressure set point and the tolerances above and below the set point as indicated at block 488. It should be understood that when the software program is executed the first time after the alternative embodiment air pressure system is powered up, the selected weight range will be considered to be a new weight range by microprocessor 184.

After the pressure set points and tolerances are re-established at block 488 or if the selected weight range has not been changed as determined at block 486, microprocessor 184 sends a signal on the appropriate signal line 478 to the respective actuator 470, 472, 474 to open the valve 452, 454, 456 associated with the selected mattress zone 131, 132, 136 by one step as indicated at block 490. After the valve 452, 454, 456 associated with the selected mattress zone 131, 132, 136 is opened by one step, microprocessor 184 reads the value of the pressure in the selected mattress zone 131, 132, 136 which is communicated to microprocessor 184 from pressure sensor 442 as indicated at block 492 of FIG. 11 a. After reading the pressure of the selected mattress zone 131, 132, 136, microprocessor 184 determines whether the selected mattress zone 131, 132, 136 needs inflation as indicated at block 494. Microprocessor 184 makes the determination at block 494 by comparing the value of pressure read at block 492 with a low-limit pressure which is calculated based on the set point and tolerance established at block 488. If the pressure in the selected mattress zone 131, 132, 136 is below the low-limit pressure, then the selected mattress zone 131, 132, 136 needs inflation.

If microprocessor 184 determines at block 492 that the selected mattress zone 131, 132, 136 needs inflation, microprocessor 184 then sends a signal on one of signal lines 478 to actuate the actuator 470, 472, 474 associated with the selected mattress zone 131, 132, 136 to open the respective valve 452, 454, 456 by one additional step as indicated at block 496. After the valve 452, 454, 456 associated with the selected mattress zone 131, 132, 136 is opened by an additional step at block 496, microprocessor 184 then sends a signal on line 186 to run compressor 174 as indicated at block 498. Compressor 174 is run for a predetermined delay period, as indicated at block 500, and then microprocessor 184 sends a signal on line 186 to stop running compressor 174 as indicated at block 510. After compressor 174 is turned off at block 510, microprocessor 184 takes another pressure reading from pressure sensor 442 as indicated at block 492.

After microprocessor 184 takes another pressure reading at block 492, microprocessor then determines whether further inflation of the selected mattress zone 131, 132, 136 is needed as indicated at block 494. If inflation is still needed, microprocessor 182 then loops through blocks 496, 498, 500, 510 and back to block 492. Microprocessor 184 will loop through blocks 492, 494, 496, 498, 500, 510 as many times as required until the selected mattress zone 131, 136 no longer needs inflation. Each time microprocessor 184 loops through blocks 492, 494, 496, 498, 500, 510, the valve 452, 454, 456 associated with the selected mattress zone 131, 132, 136 is opened by one additional step. Thus, if the selected mattress zone 131, 132, 136 needs a small amount of inflation, the associated valve 452, 454, 456 will be stepped open by a small amount and if the selected mattress zone 131, 132, 136 needs a large amount of inflation, the associated valve 452, 454, 456 will be stepped open by a large amount. This "step-measure" process results in controlled inflation of the selected mattress zone 131, 132, 136.

If microprocessor 184 determines at block 494 that the selected mattress zone 131, 132, 136 does not need inflation, microprocessor 184 then reads the value of the pressure in the selected mattress zone 131, 132, 136 which is communicated to microprocessor 184 from pressure sensor 442 as indicated at block 512 of FIG. 11*b*. After reading the pressure of the selected mattress zone 131, 132, 136, microprocessor 184 determines whether the selected mattress zone 131, 132, 136 needs deflation as indicated at block 514. Microprocessor 184 makes the determination at block 514 by comparing the value of pressure read at block 512 with a high-limit pressure which is calculated based on the set point and tolerance established at block 488. If the pressure in the selected mattress zone 131, 132, 136 is above the high-limit pressure, then the selected mattress zone 131, 132, 136 needs deflation.

If microprocessor 184 determines at block 514 that the selected mattress zone 131, 132, 136 needs deflation, microprocessor 184 then sends a signal on one of signal lines 478 to actuate the actuator 470, 472, 474 associated with the selected mattress zone 131, 132, 136 to open the respective valve 452, 454, 456 by one additional step as indicated at block 516. After the valve 452, 454, 456 associated with the selected mattress zone 131, 132, 136 is opened by one additional step at block 516, microprocessor 184 then sends a signal on the appropriate line 278 to vent actuator 476 to open vent valve 458 by one step as indicated at block 518. After the valve 452, 454, 456 associated with the selected mattress zone 131, 132, 136 is stepped open and after vent valve 458 is stepped open, microprocessor 184 takes another pressure reading as indicated at block 512.

After microprocessor 184 takes another pressure reading at block 512, microprocessor 184 then determines whether further deflation is needed as indicated at block 514. If deflation is still needed, microprocessor 184 then loops through blocks 516, 518 and back to block 512. Microprocessor 184 loops through blocks 512, 514, 516, 518 as many times as required until the selected mattress zone 131, 136 no longer needs deflation. Each time microprocessor 184 loops through blocks 512, 514, 516, 518, the valve 452, 454, 456 associated with the selected mattress zone 131, 132, 136 and the vent valve 458 are both opened by one additional step. Thus, if the selected mattress zone 131, 132, 136 needs a small amount of deflation, the associated valve 452, 454, 456 and vent valve 458 will both be stepped open by a small amount and, if the selected mattress zone 131, 132, 136 needs a large amount of deflation, the associated valve 452, 454, 456 and vent valve 458 will both be stepped open by a large amount. This "step measure" process results in controlled deflation of the selected mattress zone 131, 132, 136.

If microprocessor 184 determines at block 514 that the selected mattress zone 131, 132, 136 does not need deflation, microprocessor 184 then determines if vent valve 458 is open as indicated at block 520. If vent valve 458 is open, which will be the case if microprocessor 184 has looped through blocks 516, 518 one or more times, microprocessor 184 sends a signal on the appropriate signal line 278 to the actuator 476 to close vent valve 458 at a fast rate as indicated at block 522.

After vent valve 458 is closed at a fast rate at block 522 or if vent valve 458 is not open, as determined at block 520, microprocessor 184 sends a signal on one of signal lines 478 to the appropriate actuator 470, 472, 474 to close the valve 452, 454, 456 associated with the selected mattress zone 131, 132, 136 at a fast rate as indicated at block 524. After the valve 452, 454, 456 associated with the selected mattress zone 131, 132, 136 is closed at a fast rate, microprocessor 184 then selects the next mattress zone 131, 132, 136 as indicated at block 526. The next mattress zone 131, 132, 136 selected at block 526 can be either of the two mattress zones 131, 132, 136 that were not selected previously. For example, if mattress zone 131 was the mattress zone selected initially, then either of mattress zones 132, 136 can be the next selected mattress zone. After the next mattress zone 131, 132, 136 is selected, microprocessor 184 loops through the software program again, beginning with block 484 of FIG. 11*a*.

Although air pressure system 170 and the alternative embodiment air pressure system including portion 370 have been described above as being used with core structure 44 of mattress structure 30 to control the pressure in air bladders 52, it is within the scope of the invention as presently perceived for air pressure system 170 and the alternative embodiment air pressure system including portion 370 to be used with other types of core structures. For example, air pressure system 170 can be used with a first alternative embodiment core structure 544 which is shown in FIGS. 12 and 13.

Figures 12, 13:
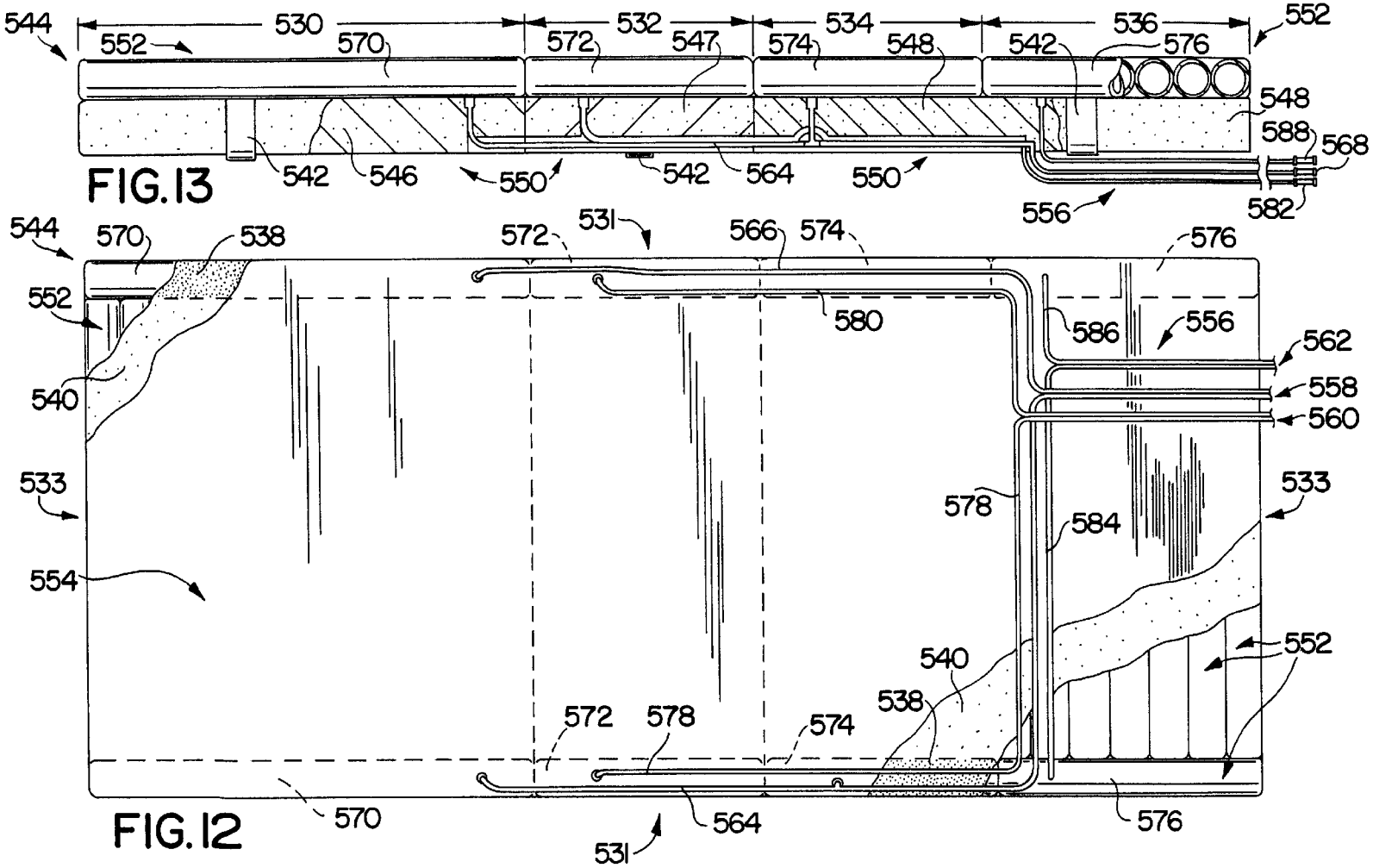
FIG. 12 is a bottom plan view of a first alternative embodiment core structure according to the present invention, with portions broken away, showing air tubes routed to a plurality of air bladders that are supported on large foam blocks.
FIG. 13 is side elevation view of the first alternative embodiment core structure of FIG. 12, with portions broken away, showing the plurality of air bladders subdivided into four zones and the large foam blocks subdivided into three zones.

Core structure 544 includes a plurality of lower support elements 550 and a plurality of upper support elements 552 that are supported by lower support elements 550 as shown best in FIG. 13. Lower support elements 550 are large foam blocks and upper support elements 552 are somewhat cylindrically-shaped air bladders. Hereinafter, the lower support elements 550 are referred to as foam blocks 550 and the upper support elements 552 are referred to as air bladders 552. Core structure 544 further includes a layer of material 554 that underlies foam blocks 550. Core structure 544 includes a set of straps that are used to secure air bladders 552 and foam blocks 550 to layer of material 554. Securing foam blocks 550 and air bladders 552 to layer of material 554 allows core structure 544 to be moved as a single unit with foam blocks 550 and air bladders 552 remaining held in the proper positions relative to one another and relative to layer of material 554. Straps 542 may include hook and loop fasteners (not shown) that attach to hook and loop fasteners (not shown) secured to layer of material 554 or straps 542 may include free ends (not shown) with other types of connectors, such as buckles or snaps that allow the free ends of straps 542 to connect together.

Air bladders 552 of core structure 544 include a pair of back section header bladders 570, a pair of seat section header bladders 572, a pair of thigh section header bladders 574, and a pair of foot section header bladders 576 as shown in FIGS. 12 and 13. The rest of the plurality of air bladders 552 extend transversely between respective header bladders 570, 572, 574, 576 and are arranged in side-by-side relation between ends 533 of core structure 544. Each of the transversely extending air bladders 552 is attached to respective header bladders 570, 572, 574, 576 in a manner substantially similar to the manner in which transversely extending bladders 52 of core structure 44 attach to header bladders 70, 72, 74, 76 as described above with reference to FIG. 5.

Core structure 544 may be included in a mattress structure used with a bed or table including an articulating deck (not shown) having pivotable head, seat, thigh, and leg sections. Header bladders 570, 572, 574, 576 and the transversely extending air bladders 552 associated therewith are sized so as to be supported by the respective deck sections of the articulating deck with which core structure 544 is used. Thus, back section header bladders 570 and the associated transversely extending air bladders 552 provide core structure 544 with a back zone 530, shown in FIG. 13, which is supported by the underlying foam block 550 and the back section of the articulating deck. Similarly, seat, thigh, and foot header bladders 572, 574, 576 and the associated transversely extending air bladders 552 provide core structure 544 with seat, thigh, and foot zones 532, 534, 536, respectively, which are supported by respective underlying foam blocks 550 and the seat, thigh, and foot sections, respectively, of the articulating deck.

The firmness and support characteristics provided by each foam block 550 depend in part upon the indention load deflection (ILD) of the foam from which each foam block is made. The ILD is a well-known industry-accepted index indicating the "firmness" of material as was described previously with reference to mattress structure 30. It is within the scope of the invention as presently perceived to provide core structure 544 in which each foam block 550 has the same ILD or to provide core structure 544 in which the ILD of at least one foam block 550 is different from the ILD of at least one other foam block 550. In addition, it is within the scope of the present invention for each foam block 550 to be comprised of portions having varying ILD's. For example, core structure 544 may be provided with foam blocks 550 each having firm end portions 538 with an ILD of about forty-four and a soft middle portion 540 with an ILD of about seventeen as shown in FIG. 12. Firm end portions 538 are sized so as to support the respective overlying header bladders 570, 572, 574, 576 to provide core structure 544 with more firmness along sides 531 thereof.

Core structure 544 includes a plurality of air tubes 556 that are routed to each of header bladders 570, 572, 574, 576 as shown best in FIG. 12. Tubes 556 include a first zone tube set 558, a second zone tube set 560, and a third zone tube set 562. First zone tube set 558 includes a pressure tube 564 that fluidly couples to one of the back section header bladders 570 and to one of the thigh section header bladders 574. First zone tube set 558 also includes a sensor tube 566 that fluidly couples to the other of the back section header bladders 570. Pressure tube 564 and sensor tube 566 each couple to a single, dual-passage tube connector 568 shown in FIG. 13. Second zone tube set 560 includes a pressure tube 578 that fluidly couples to one of the seat section header bladders 572 and a sensor tube 580 that fluidly couples to the other of the seat section header bladders 572. Pressure tube 578 and sensor tube 580 each couple to a single, dual-passage tube connector 582. Third zone tube set 562 includes a pressure tube 584 that fluidly couples to one of the foot section header bladders 576 and a sensor tube 586 that fluidly couples to the other of the foot section header bladders 576. Pressure tube 584 and sensor tube 586 each couple to a single, dual-passage tube connector 588. Foam blocks 550 are each formed with passages and slits that allow respective air tubes 556 to be routed therethrough to connect with respective header bladders 570, 572, 574, 576. Routing air tubes 556 through foam blocks 550 in this manner helps to secure air bladders 552 in the proper position relative to foam blocks 550.

Although air pressure system 170 includes manifold 176 with four valves 252, 254, 256, 258 coupled thereto and although portion 370 of the alternative embodiment air pressure system includes manifold 376 with four valves 452, 454, 456, 458 coupled thereto, it is with the scope of the invention as presently perceived to provide an air pressure system with more or less valves and corresponding passages in the respective manifold so as to allow the pressures in the air bladders of more or less mattress zones, respectively, to be controlled. For example, an air pressure system having a manifold with more valves and passages than manifolds 176, 376 can be used with a second alternative embodiment core structure 644 shown in FIG. 14.

Core structure 644 includes a plurality of lower support elements 650 and a plurality of upper support elements 652 that are supported by lower support elements 650. Lower support elements 650 are foam blocks and upper support elements 652 are somewhat cylindrically-shaped air bladders. Hereinafter, the lower support elements 650 are referred to as foam blocks 650 and the upper support elements 652 are referred to as air bladders 652. Core structure 644 further includes a layer of material 654 that underlies foam blocks 650. Core structure 644 includes a plurality of sleeves 610 that are anchored to layer of material 654 and that are configured to receive foam blocks 650 in a manner substantially similar to the manner in which sleeves 100 are configured to receive foam blocks 50 as described above with reference to core structure 44. In addition, core structure 644 includes a plurality of tethers 612 that connect transversely extending air bladders 652 to layer of material 654 in a manner substantially similar to the manner in which tethers 128 connect air bladders 52 to layer of material 54 as also described above with reference to core structure 44.

Figure 14:
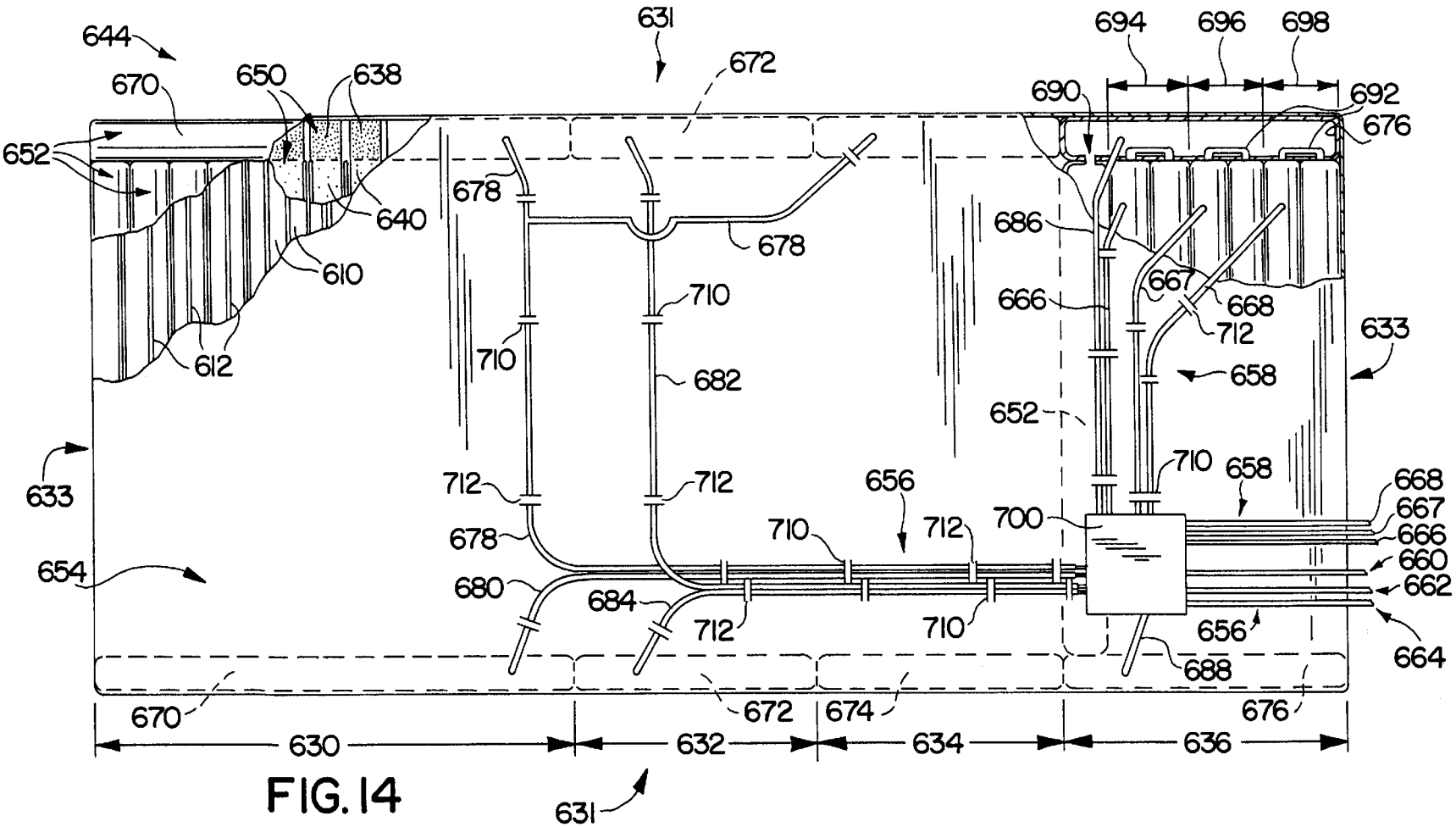
FIG. 14 is a bottom plan view of a second alternative embodiment core structure according to the present invention, with portions broken away, showing air tubes routed in an alternative pattern to a plurality of air bladders to provide the second alternative embodiment core structure with a heel relief section.

Air bladders 652 of core structure 644 include a pair of back section header bladders 670, a pair of seat section header bladders 672, a pair of thigh section header bladders 674, and a pair of foot section header bladders 676 as shown in FIG. 14. The rest of the plurality of air bladders 652 extend transversely between respective header bladders 670, 672, 674, 676 and are arranged in side-by-side relation between ends 633 of core structure 644. The transversely extending air bladders 652 positioned to lie between header bladders 670, 672, 674 are attached thereto in a manner substantially similar to the manner in which transversely extending bladders 52 of core structure 44 attach to header bladders 70, 72, 74, 76 as described above with reference to FIG. 5. The manner in which the transversely extending air bladders 652 positioned to lie between header bladders 676 are attached thereto is described below in more detail.

Core structure 644 may be included in a mattress structure used with a bed or table including an articulating deck (not shown) having pivotable head, seat, thigh, and leg sections. Header bladders 670, 672, 674, 676 and the transversely extending air bladders 652 associated therewith are sized so as to be supported by the respective deck sections of the articulating deck with which core structure 644 is used. Thus, back section header bladders 670 and the associated transversely extending air bladders 652 provide core structure 644 with a back zone 630, shown in FIG. 14, which is supported by the underlying foam block 650 and the back section of the articulating deck. Similarly, seat, thigh, and foot header bladders 672, 674, 676 and the associated transversely extending air bladders 652 provide core structure 644 with seat, thigh, and foot zones 632, 634, 636, respectively, which are supported by respective underlying foam blocks 650 and the seat, thigh, and foot sections, respectively, of the articulating deck.

The firmness and support characteristics provided by each foam block 650 depend in part upon the indention load deflection (ILD) of the foam from which each foam block is made. The ILD is a well-known industry-accepted index as previously described. It is within the scope of the invention as presently perceived to provide core structure 644 in which each foam block 650 has the same ILD or to provide core structure 644 in which the ILD of at least one foam block 650 is different from the ILD of at least one other foam block 650. In addition, it is within the scope of the present invention for each foam block 650 to be comprised of portions having varying ILD's. For example, core structure 644 may be provided with foam blocks 650 each having firm end portions 638 with an ILD of about forty-four and a soft middle portion 640 with an ILD of about seventeen as shown in FIG. 14. Firm end portions 638 are sized so as to support the respective overlying header bladders 670, 672, 674, 676 to provide core structure 644 with more firmness along sides 631 thereof.

Core structure 644 includes a plurality of air tubes 656 that are routed to each of header bladders 670, 672, 674, 676 as shown in FIG. 14. Core structure 644 also includes a plurality of heel-relief tubes 658 that are routed to designated transversely extending air bladders 652 associated with foot zone 636. Tubes 656 include a first zone tube set 660, a second zone tube set 662, and a third zone tube set 664. Core structure 644 includes a tube storage housing 700 having a compartment (not shown) in which end portions (not shown) of tubes 656, 658 are stored after tubes 656, 658 are coiled up when disconnected from the respective air pressure system that controls the air pressure of air bladders 652. Layer of material 654 is formed to include a plurality of small slits 710 which define a plurality of pass-through bands 712. Tubes 656, 658 are routed through slits 710 so that pass-through bands 712 secure tubes 656, 658 to layer of material 654 in the desired routing pattern as shown in FIG. 14.

First zone tube set 660 includes a pressure tube 678 that fluidly couples to one of the back section header bladders 670 and to one of the thigh section header bladders 674. First zone tube set 660 also includes a sensor tube 680 that fluidly couples to the other of the back section header bladders 670. Pressure tube 678 and sensor tube 680 each couple to a single, dual-passage tube connector (not shown). Second zone tube set 662 includes a pressure tube 682 that fluidly couples to one of the seat section header bladders 672 and a sensor tube 684 that fluidly couples to the other of the seat section header bladders 672. Pressure tube 682 and sensor tube 684 each couple to a single, dual-passage tube connector (not shown). Third zone tube set 664 includes a pressure tube 686 that fluidly couples to one of the foot section header bladders 676 and a sensor tube 688 that fluidly couples to the other of the foot section header bladders 676. Pressure tube 686 and sensor tube 688 each couple to a single, dual-passage tube connector (not shown).

Both header bladders 676 of foot zone 636 are attached to the transversely extending air bladder 652 which is adjacent to thigh section 634, for example, by RF welding as shown in FIG. 14. A fluid port 690 is formed at the area of attachment so that header bladders 676 are each fluidly coupled to the transversely extending air bladder 652 adjacent to thigh zone 634. The other transversely extending air bladders 652 of foot zone 636 are grouped into pairs and the air bladders 652 of each pair are fluidly coupled together by respective connector tubes 692. Each connector tube 692 is positioned to lie in an interior region 694 of the respective header bladder 676 as shown in FIG. 14. In addition, each connector tube 692 is configured to isolate the respective grouped pairs of air bladders 652 from the pressure established in header bladders 676.

Heel-relief tubes 658 include a short-heel tube 666 that fluidly couples to the grouped pair of air bladders 652 positioned closest to thigh zone 634, a tall-heel tube that fluidly couples to the grouped pair of air bladders 652 positioned at end 633 of core structure 644, and a medium-heel tube 667 that fluidly couples to the grouped pair of air bladders 652 positioned between the grouped pairs of air bladders 652 associated with tubes 666, 668. The air pressure in each pair of the three grouped pairs of air bladders 652 between header bladders 676 is controlled separately from the air pressure in each of the other grouped pairs of air bladders 652. Thus, core structure 644 is provided with a short heel-relief zone 694, a medium heel-relief zone 696, and a tall heel-relief zone 698 as shown in FIG. 14.

Air tubes 660, 662, 664 are each "dual tube" tube sets 660, 662, 664 and heel relief tubes 658 are each "single tube" tubes 666, 667, 668. Thus, an air pressure system having a portion that is like air pressure system 170 and having a portion that is like the alternative embodiment air pressure system including portion 370 may be used to control the pressure in air bladders 652 of core structure 644. The air pressure system used to control the pressure in air bladders 652 of core structure 644 should be configured so that the air bladders 652 of one of heel-relief zones 694, 696, 698 can be deflated while the air bladders 652 of the other heel-relief zones 694, 696, 698 remain inflated. In use, the heel-relief zone 694, 696, 698 to be deflated is the one that underlies the heels of a patient supported by core structure 644. Deflating the heel-relief zone 694, 696, 698 that underlies the heels of the patient minimizes or eliminates the interface pressure between the heels of the patient and core structure 644.

The air pressure system associated with core structure 644 includes controls such as, for example, knobs or switches (not shown). Each of the knobs or switches is associated with a respective one of heel-relief zones 694, 696, 698 and is movable from a first position in which the associated heel-relief zone 694, 696, 698 is inflated to a normal operating pressure and a second position in which the associated heel-relief zone 694, 696, 698 is either maintained at a pressure below the normal operating pressure or vented to the atmosphere. It should be understood that other types of controls can be used in lieu of the knobs or switches and that such controls can be accessible on panels of a housing, such as panels 296, 298, 300 of housing 172 of air pressure system 170.

Figure 15:
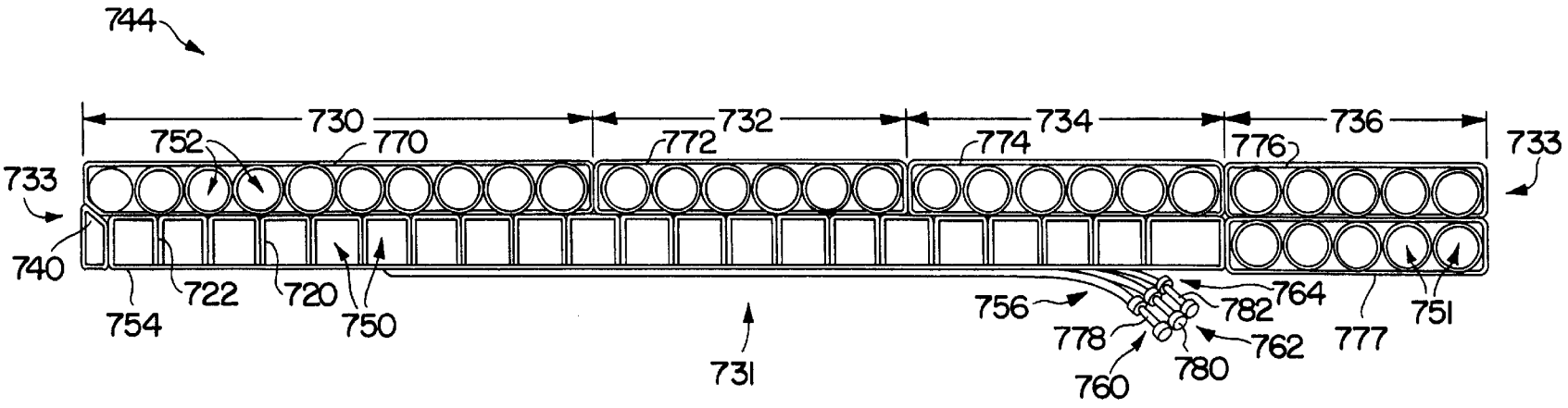
FIG. 15 is a side elevation view of a third alternative embodiment core structure according to the present invention, with portions broken away, showing a plurality of foam blocks at the head, seat, and thigh sections, a plurality of air bladders supported over the foam blocks at the head, seat, and thigh sections, and a double layer of air bladders at the foot section to provide the third alternative embodiment core structure with a heel relief section.

Although the above-described core structures 44, 544, 644, 844 each include air bladders 52, 552, 652, 52 respectively, that are supported by foam blocks 50, 550, 650, 50 respectively, it is within the scope of the invention as presently perceived for one or more portions of a core structure to include a lower layer of air bladders that support an upper layer of air bladders. For example, a fourth alternative embodiment core structure 744 having such an arrangement is shown in FIG. 15.

Core structure 744 includes a plurality of lower support elements 750 and a plurality of upper support elements 752 that are supported by lower support elements 750. Some of lower support elements 750 are foam blocks, hereinafter referred to as foam blocks 750, and some of lower support elements 750 are air bladders, hereinafter referred to as air bladders 751. All of the upper support elements 752 are somewhat cylindrically-shaped air bladders, hereinafter referred to as air bladders 752. Core structure 744 further includes a layer of material 754 that underlies foam blocks 750 and air bladders 751. Core structure 744 includes a plurality of sleeves 720 that are anchored to layer of material 754 and that are configured to receive foam blocks 750 in a manner substantially similar to the manner in which sleeves 100 are configured to receive foam blocks 50 as described above with reference to core structure 44. In addition, core structure 744 includes a plurality of tethers 722 that connect a majority of the transversely extending air bladders 752 to layer of material 754 in a manner substantially similar to the manner in which tethers 128 connect air bladders 52 to layer of material 54 as also described above with reference to core structure 44. Air bladders 751 are attached to layer of material 754 and air bladders 752 are attached to air bladders 751, for example, by RF welding.

Air bladders 752 of core structure 744 include a pair of back section header bladders 770, a pair of seat section header bladders 772, a pair of thigh section header bladders 774, and a pair of upper foot section header bladders 776. The rest of the plurality of air bladders 752 extend transversely between respective header bladders 770, 772, 774, 776 and are arranged in side-by-side relation between ends 733 of core structure 744. Air bladders 751 of core structure 744 include a pair of lower foot section header bladders 777 positioned to lie underneath header bladders 776 as shown in FIG. 15. The rest of air bladders 751 are arranged in side-by-side relation between header bladders 777. The transversely extending air bladders 751, 752 positioned to lie between header bladders 770, 772, 774, 776, 777 are attached thereto in a manner substantially similar to the manner in which transversely extending bladders 52 of core structure 44 attach to header bladders 70, 72, 74, 76 as described above with reference to FIG. 5.

Core structure 744 may be included in a mattress structure used with a bed or table including an articulating deck (not shown) having pivotable head, seat, thigh, and leg sections. Header bladders 770, 772, 774, 776, 777 and the transversely extending air bladders 751, 752 associated therewith are sized so as to be supported by the respective deck sections of the articulating deck with which core structure 744 is used. Thus, back section header bladders 770 and the associated transversely extending air bladders 752 provide core structure 744 with a back zone 730, shown in FIG. 15, which is supported by the underlying foam blocks 750 and the back section of the articulating deck. Similarly, seat and thigh section header bladders 772, 774 and the associated transversely extending air bladders 752 provide core structure 744 with seat and thigh zones 732, 734 respectively, which are supported by respective underlying foam blocks 750 and the seat and thigh sections, respectively, of the articulating deck. In addition, upper foot section header bladders 776 and the associated transversely extending air bladders 752 provide core structure 744 with a foot zone 736 which is supported by underlying air bladders 751 and the foot section of the articulating deck.

The firmness and support characteristics provided by each foam block 750 depend in part upon the indention load deflection (ILD) of the foam from which each foam block is made as previously described. It is within the scope of the invention as presently perceived to provide core structure 744 in which each foam block 750 has the same ILD or to provide core structure 744 in which the ILD of at least one foam block 750 is different from the ILD of at least one other foam block 750. In addition, it is within the scope of the present invention for each foam block 750 to be comprised of portions having varying ILD's.

Core structure 744 includes a plurality of air tubes 756 that are routed to each of header bladders 770, 772, 774, 777. Tubes 756 include a first zone tube set 760, a second zone tube set 762, and a third zone tube set 764. First zone tube set 760 includes a pressure tube (not shown) that fluidly couples to one of the back section header bladders 770 and to one of the thigh section header bladders 774. First zone tube set 760 also includes a sensor tube (not shown) that fluidly couples to the other of the back section header bladders 770. The pressure tube and the sensor tube of first zone tube set 760 each couple to a single, dual-passage tube connector 778. Second zone tube set 762 includes a pressure tube (not shown) that fluidly couples to one of the seat section header bladders 772 and a sensor tube (not shown) that fluidly couples to the other of the seat section header bladders 772. The pressure tube and the sensor tube of second zone tube set 762 each couple to a single, dual-passage tube connector 780. Third zone tube set 764 includes a pressure tube (not shown) that fluidly couples to one of the lower foot section header bladders 777 and a sensor tube (not shown) that fluidly couples to the other of the lower foot section header bladders 777. The pressure tube and the sensor tube of third zone tube set 764 each couple to a single, dual-passage tube connector 782.

Air bladders 751, 752 of foot section 736 are fluidly coupled together so that substantially the same air pressure is established in each of air bladders 751, 752 of foot section 736. Air bladders 751, 752 of foot section 736 can be deflated by varying amounts to provide core structure 744 with a varying amount of heel relief. When air bladders 751, 752 of foot section 736 are deflated, the interface pressure between the heels of a patient support and core structure 744 is reduced. In illustrated embodiments, the air pressure system coupled to core structure 744 includes a control, such as a knob, a switch, or a button, that is engageable to operate the air pressure system in a "normal" mode having foot section 736 inflated to a normal operating pressure and a "heel-relief" mode in which the pressure in air bladders 751, 752 of foot zone 736 is maintained below the normal operating pressure of foot zone 736. Deflating foot zone 736 below the normal operating pressure minimizes or eliminates the interface pressure between the heels of the patient and core structure 744.

The transversely extending air bladder 752 of thigh zone 734 that is closest to foot zone 736 is not tethered to layer of material 754 and the foam block 750 adjacent to foot zone 736 is slightly larger than the other foam blocks 750 so that the air bladder 752 of thigh zone 734 closest to foot zone 736 is supported thereon as shown in FIG. 15. In addition, the foam block at end 733 of core structure 744 beneath back zone 730 is slightly smaller than the other foam blocks 750 and includes and inclined portion 740 that helps to prevent air bladders 752 from shifting beyond end 733 of the underlying foam blocks.

Air pressure systems associated with any of the above-described core structures 44, 544, 644, 744, may include a "max inflate" control, such as a knob, a switch, or a button. The max inflate control is engageable to cause all of the air bladders of the associated core structure 44, 544, 644, 744 to inflate to a maximum pressure, such as, for example, twenty-six inches of water. When the max inflate control is actuated, the control algorithm of the air pressure system is executed in the same manner as when the max inflate control is not actuated, but the pressure set point in each mattress zone of the associated core structure 44, 544, 644, 744 is set to a predetermined maximum level. Inflating the air bladders of each mattress zone to a maximum level increases the firmness of the patient-support surface which is desirable, for example, during transfer of the patient from the mattress to another patient-support device.

Figure 16:
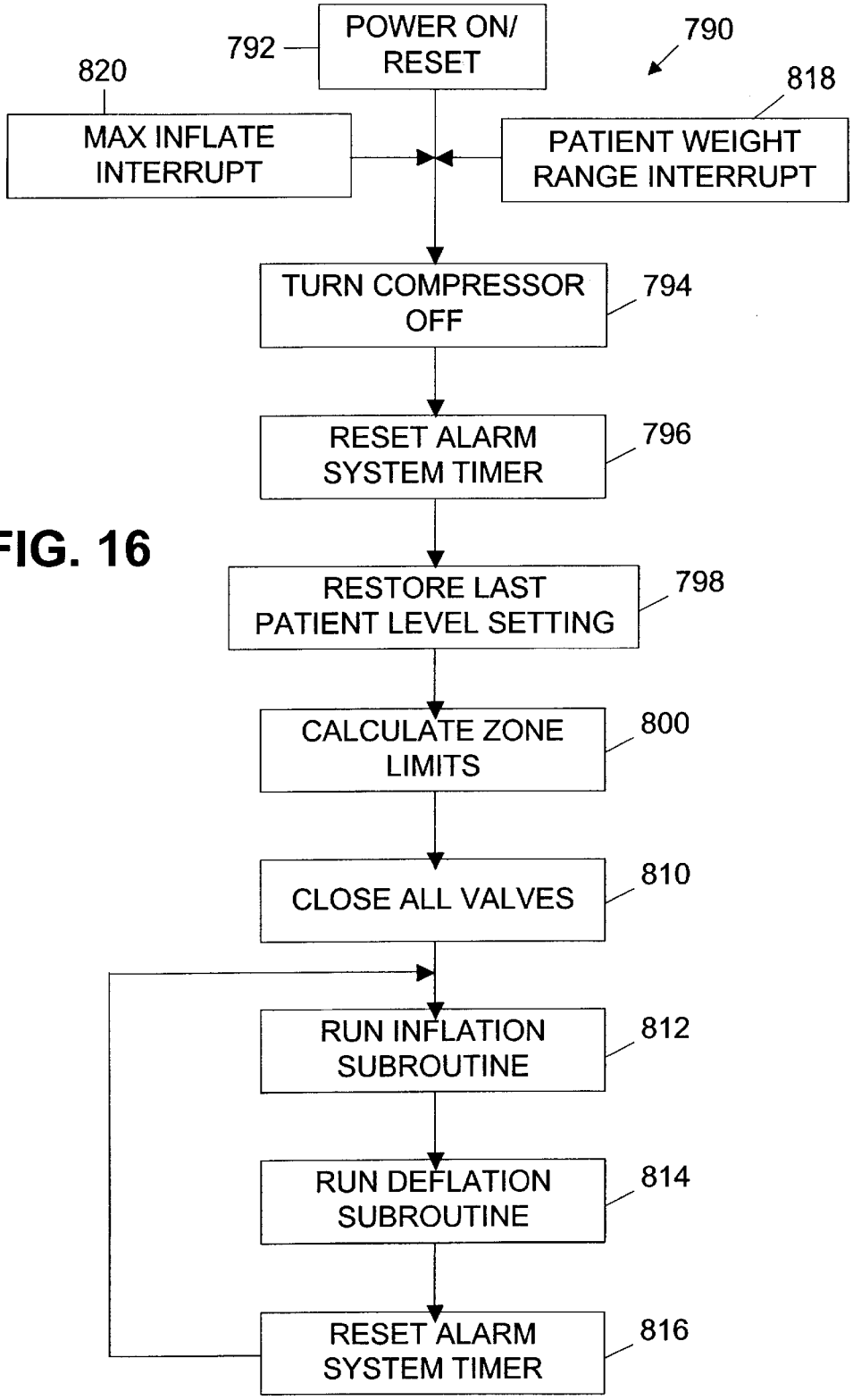
FIG. 16 is a flow diagram showing some of the steps performed by an air pressure system including a max inflate button in processing a main control algorithm.

FIGS. 16, 17*a*, 17*b*, 18*a*, and 18*b* show flow charts of one possible software program that microprocessor 184 of an air pressure system similar to air pressure system 170, but including a max inflate button, may execute to control the inflation and deflation of air bladders of an associated core structure, such as core structure 44. FIG. 16 shows a flow chart of a main program 790. Main program 790 begins at block 792 when the associated air pressure system, hereinafter referred to as system 170, is powered on initially or is reset at any time during execution. After system 170 is powered on or reset, microprocessor 184 sends a signal to ensure that the associated compressor is turned off as indicated at block 794 of FIG. 16. Microprocessor 184 then resets an alarm system timer as indicated at block 796.

An alarm (not shown) is controlled by the alarm system timer, which is reset each time a complete pass is made through main program 790. If system 170 is unable to make a complete pass through main program 790 in a predetermined time period, such as, for example, fifteen minutes, a soft reset is performed by the software. System 170 is then given an additional period of time, such as, for example, fifteen minutes, to make a complete pass through main program 170. If system 170 is still unable to make a complete pass through main program 170, all zone valves are opened, the compressor is turned of; audible and visual alarms are activated, and system operation is halted.

After microprocessor 184 resets the alarm system timer at block 796 of FIG. 16, microprocessor 184 restores the last patient level settings as indicated at block 798 and then calculates the zone tolerance limits as indicated at block 800. Next, microprocessor 184 sends appropriate signals to close all valves as indicated at block 810 of FIG. 16. After all valves are closed by microprocessor 184, an inflation subroutine is executed by microprocessor 184 as indicated at block 812 and then a deflation subroutine is executed as indicated at block 814. Inflation subroutine 812, which is discussed in detail below with reference to FIGS. 17*a* and 17*b*, causes the air bladders of the associated core structure to be inflated to the proper levels and the deflation subroutine 814, which is discussed in detail below with reference to FIGS. 18*a* and 18*b*, causes the air bladders of the associated core structure to be deflated to the proper levels. After each of subroutines 812, 814 is executed, microprocessor 184 resets the alarm system timer as indicated at block 816.

After microprocessor 184 resets the alarm system timer at block 816, main program 790 loops through blocks 812, 814 again to run the inflation and deflation subroutines again. During normal operation, microprocessor 184 will execute main program 790 so as to loop continuously through blocks 812, 814, 816 until system 170 is powered down or until an interrupt occurs. One interrupt that may occur during execution of main program 790 is a patient weight range interrupt as indicated at block 818. A patient weight range interrupt occurs when a caregiver inputs new data with an associated weight range selector, such as weight range selector 284. After interrupt 818 occurs, the air bladder pressures and tolerances are recalculated and main program 790 then resumes normal execution. Another interrupt that may occur during normal execution of main program 790 is a max inflate interrupt as indicated at block 820. A max inflate interrupt occurs when the caregiver presses the max inflate button to fully inflate the air bladders as previously described.

Although each of interrupts 818, 820 is indicated in FIG. 16 by phantom arrows that connect to the remainder of main program 790 between block 792 and block 794, it should be understood that interrupts 818, 820 may occur at any point during the execution of main program 790. After the execution of an associated interrupt subroutine (not shown), main program 790 resumes normal execution at the point where the interrupt 818, 820 occurred.

Figure 17A:
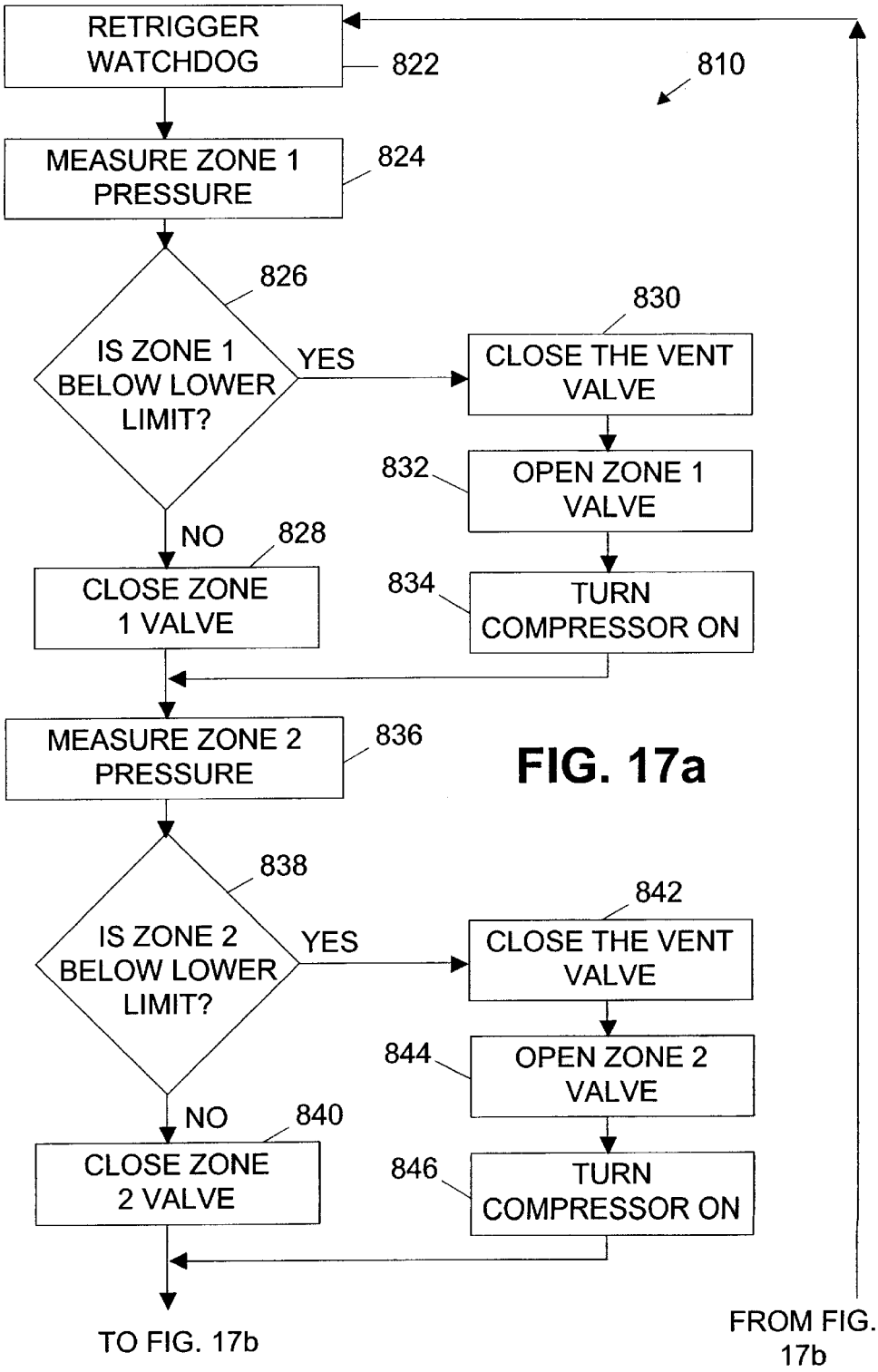
FIG. 17*a* is a first portion of a flow diagram showing some of the steps performed by an inflation subroutine associated with the main control algorithm of FIG. 16.

During execution of inflation subroutine 812, microprocessor 184 first retriggers a watchdog timer as indicated at block 822 of FIG. 17*a*. The watchdog timer provides a hardware reset to system 170 causing main program 170 to jump to block 792 if the watchdog timer is not retriggered by the software within a predetermined time period, such as, for example, six-hundred milliseconds.

After the watchdog timer is retriggered at block 822, microprocessor 184 reads the pressure sensor associated with the first mattress zone, thereby measuring the pressure in the first mattress zone as indicated at block 824. Microprocessor 184 then determines at block 826 whether the pressure in the first mattress zone is below the lower limit. If the first mattress zone is not below the lower limit, microprocessor 184 sends a signal to close the valve associated with the first mattress zone as indicated at block 828 of FIG. 17*a*. If the first mattress zone is below the lower limit, microprocessor 184 first sends a signal to close the vent valve as indicated at block 830, then sends a signal to open the valve associated with the first mattress zone as indicated at block 832, and next sends a signal to turn the compressor on as indicated at block 834 so that the compressor operates to inflate the first mattress zone.

After execution of the program steps associated with either block 828 or block 834, microprocessor 184 reads the pressure sensor associated with the second mattress zone, thereby measuring the pressure in the second mattress zone as indicated at block 836. Microprocessor 184 then determines at block 838 whether the pressure in the second mattress zone is below the lower limit. If the second mattress zone is not below the lower limit, microprocessor 184 sends a signal to close the valve associated with the second mattress zone as indicated at block 840 of FIG. 17*a*. If the second mattress zone is below the lower limit, microprocessor 184 first sends a signal to close the vent valve as indicated at block 842, then sends a signal to open the valve associated with the second mattress zone as indicated at block 844, and next sends a signal to turn the compressor on as indicated at block 846 so that the compressor operates to inflate the second mattress zone.

Figure 17B:
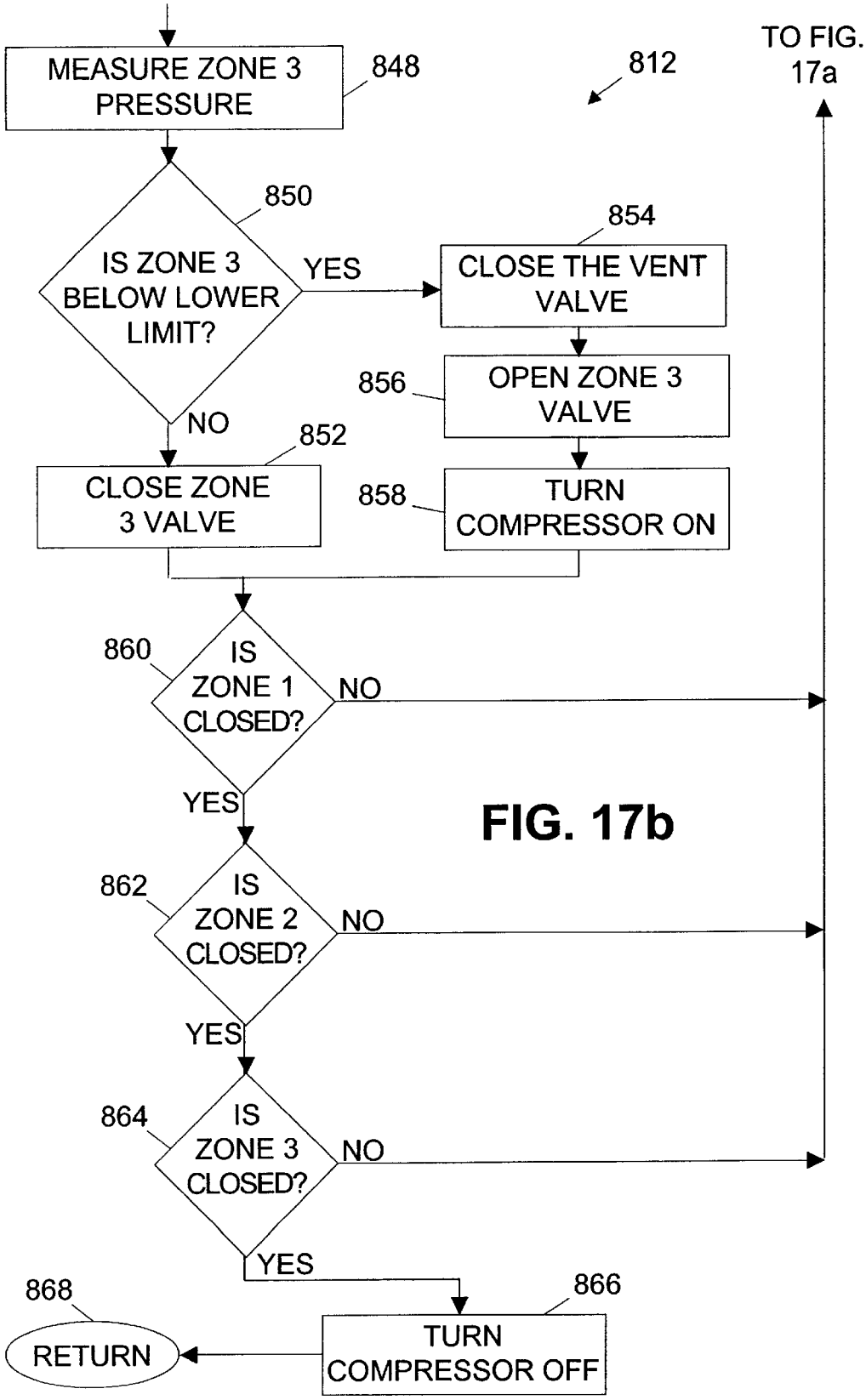
FIG. 17*b* is a second portion of a flow diagram showing some additional steps performed by an inflation subroutine associated with the main control algorithm of FIG. 16.

After execution of the program steps associated with either block 840 or block 846, microprocessor 184 reads the pressure sensor associated with the third mattress zone, thereby measuring the pressure in the third mattress zone as indicated at block 848 of FIG. 17*b*. Microprocessor 184 then determines at block 850 whether the pressure in the third mattress zone is below the lower limit. If the third mattress zone is not below the lower limit, microprocessor 184 sends a signal to close the valve associated with the third mattress zone as indicated at block 852 of FIG. 17*b*. If the third mattress zone is below the lower limit, microprocessor 184 first sends a signal to close the vent valve as indicated at block 854, then sends a signal to open the valve associated with the third mattress zone as indicated at block 856, and next sends a signal to turn the compressor on as indicated at block 858 so that the compressor operates to inflate the second mattress zone.

After execution of the program steps associated with either block 852 or block 858, microprocessor 184 checks to see if the valves associated with respective first, second, and third mattress zones are closed as indicated at blocks 860, 862, 864, respectively, as shown in FIG. 17*b*. If any of the valves associated with the first, second, and third mattress zones are not closed, which means that at least one of the mattress zones required inflation during the execution of inflation subroutine 812, microprocessor returns to block 822 of FIG. 17*a* and loops back through inflation subroutine 812 again. If all of the valves associated with the first, second, and third mattress zones are closed, which means that none of the mattress zones require inflation during the execution of inflation subroutine 812, microprocessor 184 sends a signal to turn the compressor off as indicated at block 866 and then returns to main program 790 as indicated at block 868.

Figure 18A:
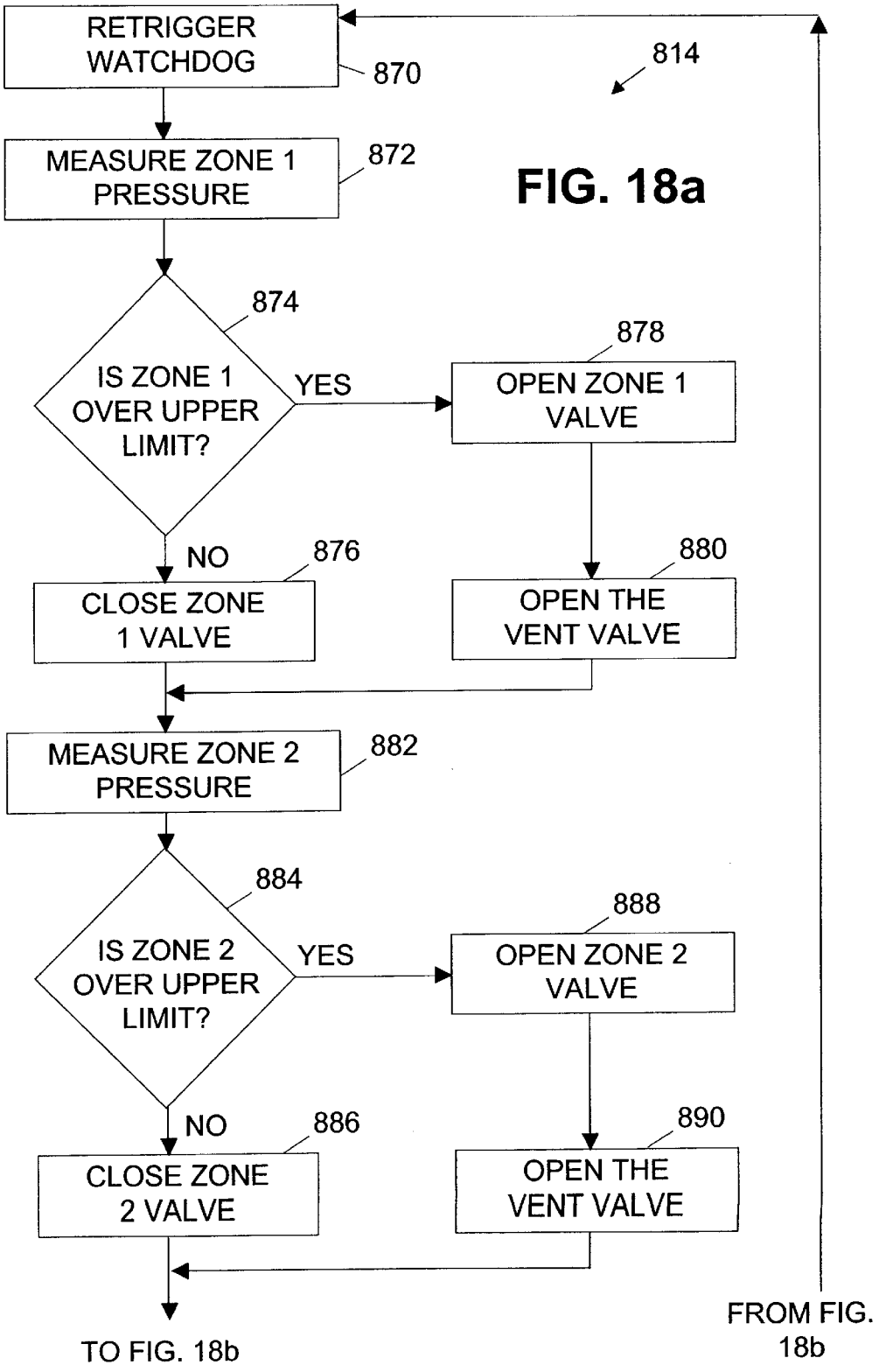
FIG. 18*a* is a first portion of a flow diagram showing some of the steps performed by a deflation subroutine associated with the main control algorithm of FIG. 16.

During execution of deflation subroutine 814, microprocessor 184 first retriggers the watchdog timer as indicated at block 870 of FIG. 18*a*. After the watchdog timer is retriggered at block 870, microprocessor 184 reads the pressure sensor associated with the first mattress zone, thereby measuring the pressure in the first mattress zone as indicated at block 872. Microprocessor 184 then determines at block 874 whether the pressure in the first mattress zone is over the upper limit. If the first mattress zone is not above the upper limit, microprocessor 184 sends a signal to close the valve associated with the first mattress zone as indicated at block 876 of FIG. 18*a*. If the first mattress zone is above the upper limit, microprocessor 184 first sends a signal to open the valve associated with the first mattress zone as indicated at block 878 and then sends a signal to open the vent valve as indicated at block 880 so that air in the first mattress zone bleeds to the atmosphere.

After execution of the program steps associated with either block 876 or block 880, microprocessor 184 reads the pressure sensor associated with the second mattress zone, thereby measuring the pressure in the second mattress zone as indicated at block 882. Microprocessor 184 then determines at block 884 whether the pressure in the second mattress zone is above the upper limit. If the second mattress zone is not above the upper limit, microprocessor 184 sends a signal to close the valve associated with the second mattress zone as indicated at block 886 of FIG. 18*a*. If the second mattress zone is above the upper limit, microprocessor 184 first sends a signal to open the valve associated with the second mattress zone as indicated at block 888 and then sends a signal to open the vent valve as indicated at block 890 so that air in the second mattress zone bleeds to the atmosphere.

Figure 18B:
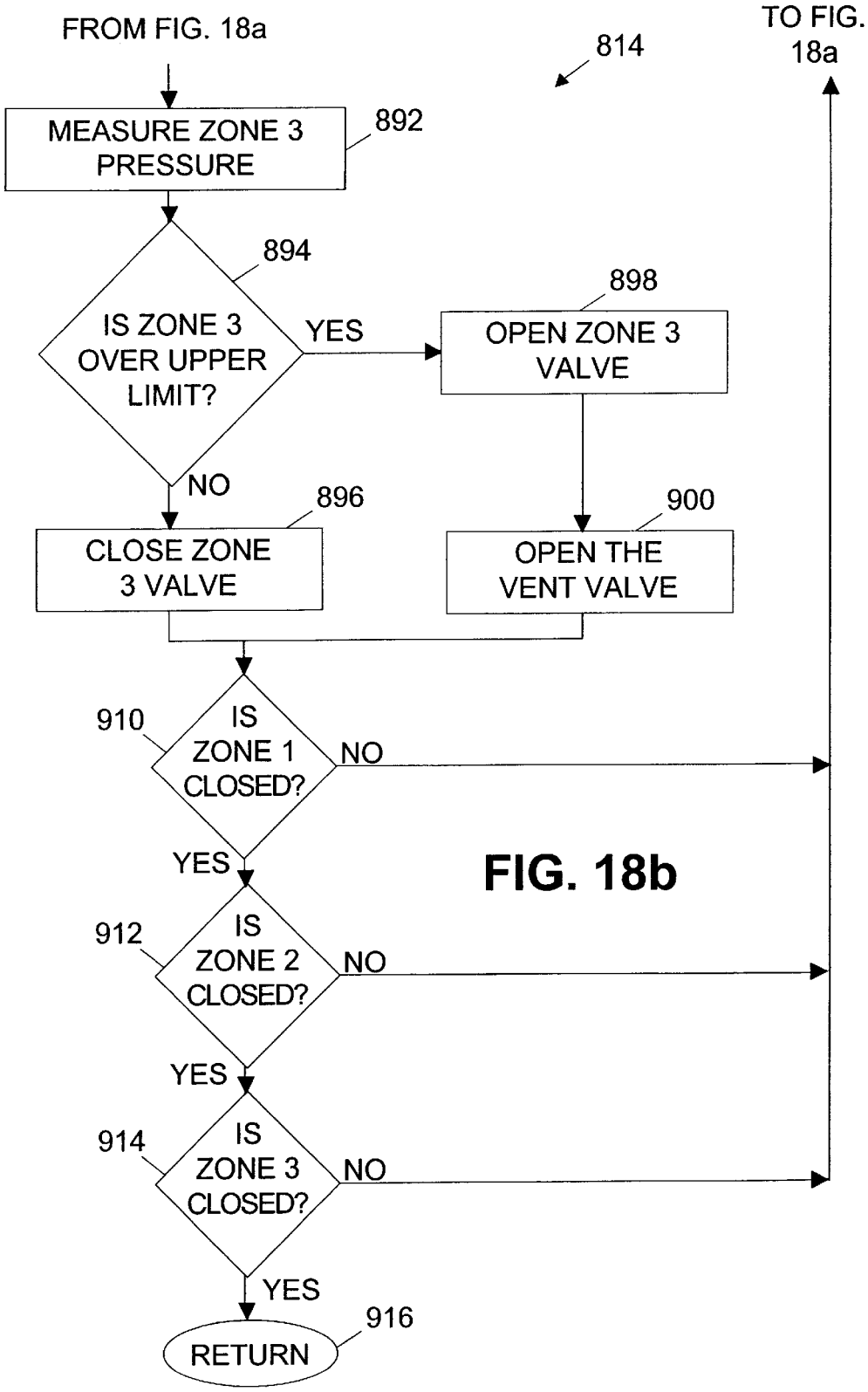
FIG. 18*b* is a second portion of a flow diagram showing some additional steps performed by a deflation subroutine associated with the main control algorithm of FIG. 16.

After execution of the program steps associated with either block 886 or block 890, microprocessor 184 reads the pressure sensor associated with the third mattress zone, thereby measuring the pressure in the third mattress zone as indicated at block 892 of FIG. 18*b*. Microprocessor 184 then determines at block 894 whether the pressure in the third mattress zone is above the upper limit. If the third mattress zone is not above the upper limit, microprocessor 184 sends a signal to close the valve associated with the third mattress zone as indicated at block 896 of FIG. 18*b*. If the third mattress zone is above the upper limit, microprocessor 184 first sends a signal to open the valve associated with the third mattress zone as indicated at block 898 and then sends a signal to open the vent valve as indicated at block 900 so that air in the third mattress zone bleeds to the atmosphere.

After execution of the program steps associated with either block 896 or block 900, microprocessor 184 checks to see if the valves associated with respective first, second, and third mattress zones are closed as indicated at blocks 910, 912, 914, respectively, as shown in FIG. 18*b*. If any of the valves associated with the first, second, and third mattress zones are not closed, which means that at least one of the mattress zones required deflation during the execution of deflation subroutine 814, microprocessor returns to block 870 of FIG. 18*a* and loops back through deflation subroutine 814 again. If all of the valves associated with the first, second, and third mattress zones are closed, which means that none of the mattress zones require deflation during the execution of deflation subroutine 814, microprocessor 184 returns to main program 790 as indicated at block 916.

Although the invention has been described in detail with reference to certain preferred embodiments, variations and modifications exist within the scope and spirit of the invention as described and defined in the following claims.

What is claimed is:

1. A mattress structure comprising:

a plurality of side-by-side lower support elements, a layer of material underlying the lower support elements, a plurality of side-by-side upper support elements overlying and being supported by the lower support elements, and a plurality of tethers, each tether connecting a respective one of the upper support elements to the layer of material, each tether extending between a respective pair of the lower support elements.

2. The mattress structure of claim 1, wherein the lower support elements are elongated, the upper support elements are elongated, and the upper support elements are arranged in substantially parallel relation with the lower support elements.

3. The mattress structure of claim 2, wherein each of the upper support elements is an inflatable air bladder.

4. The mattress structure of claim 3, wherein each air bladder has an elongated central axis and each tether includes a portion extending vertically beneath the elongated central axis.

5. The mattress structure of claim 3, wherein each air bladder is supported by a respective pair of the lower support elements so that approximately half of each air bladder is supported by a respective one of the lower support elements.

6. The mattress structure of claim 3, wherein each of the lower support elements is a foam block.

7. The mattress structure of claim 1, further comprising a plurality of sleeves, each lower support element being received in an interior region of the respective sleeve, and each tether extending between a respective pair of the sleeves.

8. The mattress structure of claim 7, wherein each sleeve is anchored to the layer of material.

9. The mattress structure of claim 8, wherein each sleeve is made of an anti-friction shear material.

10. The mattress structure of claim 7, wherein each sleeve is made of an anti-friction shear material.

11. The mattress structure of claim 10, wherein each tether is made of an anti-friction shear material.

12. The mattress structure of claim 1, further comprising a cover enclosing the plurality of side-by-side lower support elements and the plurality of side-by-side upper support elements, the cover having a bottom surface and a strap having two spaced apart free ends and a middle portion between the free ends connected to the bottom surface, the lower and upper support elements being configured to allow the mattress structure to be folded so that the free ends of the strap may be coupled together.

13. The mattress structure of claim 12, further comprising a buckle having a first buckle half and a second buckle half, the first and second buckle halves being attached to the strap, the first buckle half being coupled to the strap for movement relative to the second buckle half to adjust an effective length of the strap.

14. The mattress structure of claim 1, further comprising a cover enclosing the plurality of side-by-side lower support elements and the plurality of side-by-side upper support elements, the cover having a bottom surface and an anti-skid pad coupled to the bottom surface.

15. A mattress structure having longitudinally spaced-apart ends and transversely spaced-apart sides, the mattress structure comprising:

a plurality of foam blocks arranged in side-by-side relation between the ends of the mattress structure, each foam block extending transversely between the sides of the mattress structure, a layer of material underlying the foam blocks, the layer of material extending between the sides of the mattress structure and between the ends of the mattress structure, a plurality of inflatable air bladders overlying and being supported by the foam blocks, the air bladders being arranged in side-by-side relation between the ends of the mattress structure, each air bladder extending transversely between the sides of the mattress structure, and a plurality of tethers, each tether connecting a respective one of the air bladders to the layer of material, and each tether including a portion positioned to lie between a respective pair of adjacent foam blocks.

16. The mattress structure of claim 15, further comprising a plurality of sleeves, each sleeve including an interior region configured to receive a respective one of the foam blocks, each sleeve being fastened to the layer of material, and the portion of each tether positioned to lie between a respective pair of adjacent foam blocks also being positioned to lie between a respective pair of adjacent sleeves.

17. The mattress structure of claim 16, wherein each tether is a sheet of material and each of the adjacent sleeves contacts the sheet of material.

18. The mattress structure of claim 17, wherein each tether is made of a shear material having a low coefficient of friction and each sleeve is made of a shear material having a low coefficient of friction.

19. The mattress structure of claim 17, wherein each sleeve is RF welded to the layer of material and each tether is RF welded to the layer of material.

20. The mattress structure of claim 17, wherein each adjacent pair of foam blocks defines a vertical reference plane therebetween and the portion of each tether positioned to lie between a respective pair of adjacent foam blocks and adjacent sleeves is positioned to lie in the vertical reference plane.

21. The mattress structure of claim 16, wherein each foam block includes two ends spaced apart by a block length and four sides extending along the block length between the two ends and each sleeve has a sleeve length that is substantially equivalent to the block length so that each sleeve completely surrounds the four sides of the foam block received in the interior region of the respective sleeve.

22. The mattress structure of claim 21, wherein each air bladder includes two ends spaced apart by a bladder length and each tether has a tether length that is substantially equivalent to the bladder length.

23. The mattress structure of claim 15, wherein each adjacent pair of foam blocks defines a vertical reference plane therebetween, each air bladder has a transversely extending central axis, and the air bladders are arranged above the foam blocks so that each vertical reference plane extends through the central axis of a respective air bladder.

24. The mattress structure of claim 15, wherein each foam blocks is comprised of at least two foam portions having non-equivalent ILD values.

25. The mattress structure of claim 24, wherein each foam block includes a central portion and end portions appended to the central portion and the end portions are stiffer than the central portion.

26. The mattress structure of claim 25, wherein the central portion of each foam block has an ILD of about seventeen and the end portions of each foam block have an ILD of about forty-one.

27. The mattress structure of claim 15, wherein each air bladder includes two transversely spaced-apart ends and each end is formed to include an aperture and further comprising a plurality of longitudinally extending header tubes, each header tube being formed to include a number of apertures, and each header tube being coupled to a set of the plurality of air bladders so that the header tube is fluidly coupled to the set of air bladders through the number of apertures of the header tube and through the apertures of the respective ends of the air bladders.

28. The mattress structure of claim 27, wherein each foam block includes a central portion and end portions appended to the central portion, the end portions are stiffer than the central portion, and the header tubes are supported by the end portions of the foam blocks.

29. A modular mattress system comprising:

a mattress including a first air bladder and a second air bladder, a compressor having an outlet, a manifold including a main passage having an inlet coupled to the outlet of the compressor and a vent coupled to the atmosphere at a vent port, a first passage fluidly coupled to the first air bladder and fluidly coupled to the main passage at a first port, and a second passage fluidly coupled to the second air bladder and fluidly coupled to the main passage at a second port, a first valve normally closing the first port and movable to open the first port, a second valve normally closing the second port and movable to open the second port, a vent valve normally closing the vent port and movable to open the vent port, a first actuator coupled to the first valve and actuatable to move the first valve, a second actuator coupled to the second valve and actuatable to move the second valve, a vent actuator coupled to the vent valve and actuatable to move the vent valve, a first pressure sensor configured to sense pressure in the first air bladder, a second pressure sensor configured to sense pressure in the second air bladder, and a microprocessor coupled to the first and second pressure sensors to receive input signals therefrom, coupled to the first, second, and vent actuators to send output signals thereto, and coupled to the compressor to send control signals thereto, the microprocessor being configured to alternately respond to the input signals from the first and second pressure sensors, the microprocessor sending output and control signals to open the first port and run the compressor if the input signal from the first pressure sensor indicates that pressure in the first air bladder is below a first predetermined level so that the first air bladder is further pressurized, the second port remaining closed by the second valve while the first port is opened, the microprocessor sending output and control signals to open both the first port and the vent port and turn off the compressor if the input signal from the first pressure sensor indicates that pressure in the first air bladder is above the first predetermined level so that air flows from the first air bladder to the atmosphere, the second port remaining closed by the second valve while the first port and the vent port are opened, the microprocessor sending output and control signals to open the second port and run the compressor if the input signal from the second pressure sensor indicates that pressure in the second air bladder is below a second predetermined level so that the second air bladder is further pressurized, the first port remaining closed by the first valve while the second port is opened, the microprocessor sending output and control signals to open both the second port and the vent port and to turn off the compressor if the input signal from the second pressure sensor indicates that pressure in the second air bladder is above the second predetermined level so that air flows from the second air bladder to the atmosphere, the first port remaining closed by the first valve while the second port and the vent port are opened.

30. The modular mattress system of claim 29, wherein each of the first, second, and vent actuators are stepper motors.

31. The modular mattress system of claim 30, wherein the first, second, and vent valves each include a tapered tip and movement of the tapered tips of the first, second, and vent valves relative to the respective first, second, and vent ports adjusts the size of an opening defined between the tapered tips of the first, second, and vent valves and the respective first, second, and vent ports.

32. The modular mattress system of claim 31, wherein the microprocessor sends output signals to adjust the position of the tips of the first valve and the vent valve based upon the amount that pressure in the first air bladder deviates from the first predetermined pressure and the microprocessor sends output signals to adjust the position of the tips of the second valve and the vent valve based upon the amount that pressure in the second air bladder deviates from the second predetermined pressure.

33. The modular mattress system of claim 31, wherein the stepper motors are each operable to adjust the position of the respective tapered tips through more than one hundred steps between a fully opened position and a fully closed position.

34. The modular mattress system of claim 29, further comprising a support level selector coupled to the microprocessor, the support level selector being configured to provide a level signal to the microprocessor based upon a support level selected by a user, and the first and second predetermined pressure levels being established based upon the level signal.

35. The modular mattress system of claim 34, further comprising indicia for indicating to the user the support level selected.

36. The modular mattress system of claim 35, wherein the indicia includes a label containing a plurality of weight ranges printed thereon, the indicia includes a plurality of indicators, each indicator is adjacent to a respective weight range, and the indicators indicate which support level is selected.

37. The modular mattress system of claim 34, wherein each of the support levels corresponds to a weight range and the first and second predetermined pressure levels increase as the weight range increases.

38. A modular mattress system comprising:

a mattress including a plurality of inflatable air bladders sets, and an air bladder inflation system including a compressor, a plurality of pressure sensors, each pressure sensor being responsive to the pressure in an associated air bladder set, and a bladder set selector that receives a pressure signal from each of the pressure sensors, the bladder set selector being responsive to only one pressure signal at a time, the bladder set selector fluidly coupling a selected one of the air bladder sets to the compressor and operating the compressor to increase the pressure in the selected air bladder set if the respective pressure sensor indicates that the pressure in the selected air bladder set is below a predetermined level, and the bladder set selector coupling the selected air bladder set to the atmosphere to allow fluid to bleed from the selected air bladder set to the atmosphere if the respective pressure sensor indicates that the pressure in the selected air bladder set is above a predetermined level, each of the unselected air bladder sets remaining fluidly decoupled from the compressor and fluidly decoupled from the atmosphere, the bladder set selector selecting each of the air bladder sets in a cyclical manner.

39. The mattress structure of claim 38, wherein the bladder set selector includes a manifold having a main passage coupled to the compressor and coupled to the atmosphere at a vent port, the manifold includes a plurality of bladder passages coupled to the main passage at respective bladder ports and coupled to respective air bladder sets, a vent valve movable to open and close the vent port, a plurality of bladder valves movable to open and close respective bladder ports, a plurality of actuators coupled to respective bladder valves and the vent valve, and a microprocessor that receives signals from the pressure sensors and sends signals to the actuators.

40. The mattress structure of claim 39, wherein the manifold is a block having a flat outer surface, the main passage and the bladder passages are formed in the block, the vent valve and the plurality of bladder valves are positioned to lie inside the block, and the actuators are mounted on the flat outer surface of the block.

41. A mattress structure having longitudinally spaced-apart ends and transversely spaced-apart sides, the mattress structure comprising:

a foot zone configured to support the feet of a patient, the foot zone including a pair of header bladders along the sides of the mattress structure and a plurality of air bladders extending between the header bladders, the header bladders and air bladders each having an interior region that receives pressurized air, an air pressure system coupled to the header bladders and air bladders and configured to control pressure within the header bladders and air bladders, and a first connector tube fluidly coupling at least two of the air bladders together so that pressure in the interior region of at least two air bladders is maintainable at a pressure different than a pressure in the interior region of at least one of the header bladders, at least a portion of the connector tube being positioned to lie in the interior region of one of the header bladders.

42. The mattress structure of claim 41, wherein the at least two air bladders fluidly coupled together by the first connector tube provide the foot zone with a first heel-relief zone and further comprising a second connector tube fluidly coupling at least two of the air bladders together so that pressure in the interior region of the air bladders fluidly coupled together by the second connector tube is maintainable at a pressure different than a pressure in the interior region of at least one of the header bladders and different than a pressure in the air bladders of the first heel-relief zone.

43. The mattress structure of claim 42, wherein the at least two air bladders fluidly coupled together by the second connector tube provide the foot zone with a second heel-relief zone and further comprising a third connector tube fluidly coupling at least two of the air bladders together so that pressure in the interior region of the air bladders fluidly coupled together by the third connector tube is maintainable at a pressure different than a pressure in the interior region of at least one of the header bladders and different than a pressure in each of the air bladders of the first and second heel-relief zones.

44. The mattress structure of claim 43, wherein the at least two air bladders fluidly coupled together by the third connector tube provide the foot zone with a third heel-relief zone, the air bladders of each of the first, second, and third heel-relief zones extend transversely between the header bladders, and the first, second, and third heel-relief zones are adjacent to one another so as to provide heel relief for patients having different heights.

45. The mattress structure of claim 43, wherein the at least two air bladders fluidly coupled together by the third connector tube provide the foot zone with a third heel-relief zone, the air pressure system is coupled to each of the first, second, and third heel relief zones so as to adjust and maintain pressure within each of the first, second, and third heel-relief zones separately.

46. The mattress structure of claim 43, wherein the second connector tube and the third connector tube each include at least a portion positioned to lie in the interior region of at least one header bladder.

47. The mattress structure of claim 42, wherein the at least two air bladders fluidly coupled together by the second connector tube provide the foot zone with a second heel-relief zone, the air bladders of each of the first and second heel-relief zones extend transversely between the header bladders, and the first and second heel-relief zones are adjacent to one another so as to provide heel relief for patients having different heights.

48. The mattress structure of claim 42, wherein the at least two air bladders fluidly coupled together by the second connector tube provide the foot zone with a second heel-relief zone, the air pressure system is coupled to the first and second heel-relief zones so as to adjust and maintain pressure within the first heel-relief zone separately from the second heel-relief zone.

49. The mattress structure of claim 41, wherein each header bladder includes a side wall and a pair of end walls appended to the side wall, each air bladder includes a side wall and a pair of end walls appended to the side wall, and a vertical height of the side wall of each header bladder is substantially equivalent to a vertical height of the side wall of each air bladder when the header bladders and air bladders are pressurized to substantially equivalent pressures.

50. The mattress structure of claim 41, wherein the interior region of at least one air bladder is fluidly coupled to the interior regions of both header bladders.

51. A mattress structure having longitudinally spaced-apart ends and transversely spaced-apart sides, the mattress structure comprising:

a first zone including a plurality of air bladders and a plurality of foam elements, the air bladders overlying the foam elements and being supported thereby, and a second zone including a plurality of upper air bladders and a plurality of lower air bladders, the upper air bladders overlying the lower air bladders and being supported thereby, each of the upper and lower air bladders including an interior region, the interior regions of the upper air bladders being fluidly coupled to the interior regions of the lower air bladders, and an air pressure system coupled to the air bladders of the first zone and coupled to the upper and lower air bladders of the second zone, the air pressure system being operable to maintain pressure in the air bladders of the first zone at a first pressure level and to maintain pressure in the upper and lower air bladders of the second zone at a second pressure level.

52. The mattress structure of claim 51, wherein the majority of the foam elements each have a substantially equivalent vertical height and each lower air bladder has a vertical height that is substantially equivalent to the vertical height of the foam elements.

53. The mattress structure of claim 52, wherein the air bladders of the first zone each have a substantially equivalent vertical height and each upper air bladder has a vertical height that is substantially equivalent to the vertical height of the air bladders of the first zone.

54. A modular mattress system comprising:

a mattress including a first air bladder and a second air bladder, a compressor having an outlet, a manifold including a main passage having an inlet coupled to the outlet of the compressor and a vent coupled to the atmosphere at a vent port, a first passage fluidly coupled to the first air bladder and fluidly coupled to the main passage at a first port, and a second passage fluidly coupled to the second air bladder and fluidly coupled to the main passage at a second port, the first passage includes a first tube and the second passage includes a second tube and said first and second tube are contiguously connected over a substantial length of the first and second tubes to form a tube ribbon, a first valve normally closing the first port and movable to open the first port, a second valve normally closing the second port and movable to open the second port, a vent valve normally closing the vent port and movable to open the vent port, a first actuator coupled to the first valve and actuatable to move the first valve, a second actuator coupled to the second valve and actuatable to move the second valve, a vent actuator coupled to the vent valve and actuatable to move the vent valve, a first pressure sensor configured to sense pressure in the first air bladder, and a second pressure sensor configured to sense pressure in the second air bladder.

55. The modular mattress of claim 54, wherein the first passage includes a first tube decouplable from the remainder of the first passage and the second passage includes a second tube decouplable from the remainder of the second passage.

56. The modular mattress of claim 55, further comprising a housing enclosing the manifold, a first internal passage, a second internal passage, a first connector extending between the interior and exterior of the housing and being internally connected to the first internal passage and externally connected to the first tube and a second connector.

57. A mattress structure comprising:

a plurality of side-by-side lower support elements, a plurality of side-by-side upper support elements overlying and being supported by the lower support elements, and a cover enclosing the plurality of side-by-side lower support elements and the plurality of side-by-side upper support elements, the cover having a bottom surface and a strap having two spaced apart free ends and a middle portion between the free ends connected to the bottom surface, the lower and upper support elements being configured to allow the mattress structure to be folded so that the free ends of the strap may be coupled together.

58. The mattress structure of claim 57, wherein the lower support elements are elongated, the upper support elements are elongated, and the upper support elements are arranged in substantially parallel relation with the lower support elements.

59. The mattress structure of claim 57, further comprising a buckle having a first buckle half and a second buckle half, the first and second buckle halves being attached to the strap, the first buckle half being coupled to the strap for movement relative to the second buckle half to adjust an effective length of the strap.

60. The mattress structure of claim 57, further comprising an anti-skid pad coupled to the bottom surface of the cover.

61. A connector apparatus configured to couple a mattress including a plurality of inflatable air bladders to an air bladder inflation system including an air supply, the connector apparatus comprising:

a first set of connectors coupled to the air supply, the first set of connectors being coupled to a first body portion;

a plurality of air supply tubes, at least one air supply tube being coupled to each of the plurality of air bladders; and a second set of connectors coupled to the air supply tubes, the second set of connectors being coupled to a second body portion, the first and second sets of connectors being in alignment with each other to permit substantially simultaneous coupling of the first and second sets of connectors, a plurality of pressure sensors, each pressure sensor being responsive to the pressure in an associated air bladder, and wherein the connector apparatus includes a third set of connectors coupled to the pressure sensors, the first and third sets of connectors being coupled to the first body portion, a plurality of pressure tubes, at least one pressure tube being coupled to each of the plurality of air bladders, and a fourth set of connectors coupled to the pressure tubes, the second and fourth sets of connectors being coupled to the second body portion, the third and fourth sets of connectors also being in alignment with each other to permit substantially simultaneous coupling of both the first set of connectors with the second set of connectors and the third set of connectors with the forth set of connectors.

62. The apparatus of claim 61, wherein the air bladder inflation system further includes a manifold having a main passage coupled to the air supply and coupled to the atmosphere at a vent port, the manifold including a plurality of bladder passages coupled to the main passage at respective bladder ports and coupled to the first set of connectors.

63. The apparatus of claim 62, further comprising a vent valve movable to open and close the vent port, a plurality of bladder valves movable to open and close respective bladder ports, and a plurality of actuators coupled to respective bladder valves and the vent valve.

64. The apparatus of claim 61, further comprising a latch configured to secure, the first and second bodies together.

65. The apparatus of claim 64, wherein the latch is coupled to one of the sets of connectors.

66. The apparatus of claim 61, wherein the air bladder inflation system includes a housing surrounding the air supply and the plurality of pressure sensors, the first body portion being coupled to the housing.

67. The apparatus of claim 61, wherein the first and second sets of connectors are unequally spaced on the first body portion and the third and fourth sets of connectors are unequally spaced on the second body portion so that the connectors can only being coupled together in a single orientation.

68. The connector apparatus of claim 61, wherein the first set of connectors are coupled to the first body portion and the second set of connectors are coupled to the second body portion so that the first and second set of connectors can only be coupled together in a single orientation.

* * * * *